US007078368B2

(12) United States Patent
Laney et al.

(10) Patent No.: US 7,078,368 B2
(45) **Date of Patent: *Jul. 18, 2006**

(54) THERMAL-DYE-TRANSFER MEDIA FOR LABELS COMPRISING POLY(LACTIC ACID) AND METHOD OF MAKING THE SAME

(75) Inventors: Thomas M. Laney, Spencerport, NY (US); Kenneth W. Best, Jr., Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 154 days.

This patent is subject to a terminal disclaimer.

(21) Appl. No.: 10/783,411

(22) Filed: Feb. 20, 2004

(65) Prior Publication Data

US 2005/0187106 A1 Aug. 25, 2005

(51) Int. Cl.
*B41M 5/035* (2006.01)
*B41M 5/38* (2006.01)

(52) U.S. Cl. ..... 503/227

(58) Field of Classification Search ..... 503/227; 8/471

See application file for complete search history.

(56) References Cited

U.S. PATENT DOCUMENTS

| | | | |
|---|---|---|---|
| 4,621,271 | A | 11/1986 | Brownstein |
| 4,984,823 | A | 1/1991 | Ishii et al. |
| 6,153,558 | A | 11/2000 | Shirai et al. |
| 6,162,517 | A | 12/2000 | Oshima et al. |
| 6,566,024 | B1 | 5/2003 | Bourdelais et al. |

*Primary Examiner*—B. Hamilton Hess
(74) *Attorney, Agent, or Firm*—Chris P. Konkol

(57) ABSTRACT

Thermal-dye-transfer labels, and pre-label media from which they are made, comprising an extruded pragmatic polymer film comprising a microvoided layer, a continuous phase of which comprises a polylactic-acid-based material. A method of making sheets for such media is also disclosed involving an extrusion process. High-quality pressure-sensitive labels for application to packages are obtainable by the present invention.

50 Claims, No Drawings

THERMAL-DYE-TRANSFER MEDIA FOR LABELS COMPRISING POLY(LACTIC ACID) AND METHOD OF MAKING THE SAME

CROSS-REFERENCE TO RELATED APPLICATION

Reference is made to commonly assigned, U.S. patent application Ser. No. 10/783,101 by Thomas M. Laney et al. filed of even date herewith entitled "THERMAL-DYE-TRANSFER MEDIA FOR LABELS COMPRISING POLY (LACTIC ACID) AND METHOD OF MAKING THE SAME" and commonly assigned, U.S. patent application Ser. No. 10/783,103 by Thomas M. Laney et al. filed of even date herewith entitled "THERMAL-DYE-TRANSFER RECEIVER ELEMENT WITH POLYLACTIC-ACID-BASED SHEET MATERIAL."

FIELD OF THE INVENTION

The invention relates to high-quality pressure-sensitive labels for application to packages.

BACKGROUND OF THE INVENTION

Pressure-sensitive labels are applied to packages to build brand awareness, show the contents of the package, convey a quality message regarding the contents of a package, and supply consumer information such as directions on product use, or an ingredient listing of the contents. Printing on the pressure-sensitive label is typically done using gravure printing or flexography. There is a continuing need to improve the visual appeal of labels to increase shelf awareness of products. Prior-art printed labels have attempted to provide improved visual information on labels by utilizing multiple print stations in a printing press to achieve "photographic quality." While nine color presses do provide a good image, thermal-dye transfer systems is an alternative that can potentially provide images having depth, excellent flesh tone replication, excellent tone scale, and superior image sharpness.

Prior-art labels that are applied to packages comprise a base for holding the image and a pressure-sensitive adhesive, previously attached to a liner (carrier). The label media (on which the image is printed) can optionally be in the form of sheets that comprise material for a plurality of labels and are typically made by laminating the necessary single or multi-layer films comprising the media. The images are printed on the label media utilizing a variety of printing methods. After printing, the media surface can be protected by an over-laminate material or a protective coating. Optionally, a plurality of individual labels can be cut into a label media after or before printing and prior to application to packaging or other uses. The completed imaged label consisting of a protection layer, printed information such as an image, base, and pressure-sensitive adhesive, is applied to packages after removing the liner utilizing high-speed labeling equipment.

One method of printing label media is flexography which is an offset letterpress technique where the printing plates are made from rubber or photopolymers. The printing on pressure-sensitive label media is accomplished by the transfer of ink from the raised surface of the printing plate to the surface of the material being printed. The rotogravure method of printing uses a print cylinder with thousands of tiny cells that are below the surface of the printing cylinder. The ink is transferred from the cells when the print cylinder is brought into contact with the pressure-sensitive label media at the impression roll. Printing inks for flexography or rotogravure include solvent-based inks, water-based inks and radiation-cured inks. While rotogravure and flexography printing do provide acceptable image quality, these two printing methods require expensive and time-consuming preparation of print cylinders or printing plates which make printing jobs of less than 100,000 units expensive as the set-up cost and the cost of the cylinders or printing plates is typically depreciated over the size of the print job.

Recently, digital printing has become a viable method for the printing of information on packages. The term "digital printing" refers to the electronic digital characters or electronic digital images that can be printed by an electronic output device capable of translating digital information. The main digital printing technologies are inkjet, electrophotography, and thermal dye transfer.

Digital inkjet printing has the potential to revolutionize the printing industry by making short-run color-print jobs more economical. However, the next commercial stage will require significant improvements in inkjet technology; the major hurdle remaining is to improve print speed. Part of this problem is the limitation of the amount of data the printer can handle rapidly. The more complex the design, the slower the printing process. Right now they are about 10 times slower than comparable digital electrostatic printers.

Another printing technique for labels is disclosed in U.S. Pat. No. 6,566,024 issued May 20, 2003 to Bourdelais et al., titled "Quintessential Pictorial label and Its Distribution," and involves silver-halide photography. Such printing on label media can provide higher quality images to packaging materials, including the printing of images using an optical digital printing system with the Pantone color space of printed inks.

In recent years, thermal transfer systems have been developed to obtain prints from pictures that have been generated electronically. According to one way of obtaining such prints, an electronic picture is first subjected to color separation by color filters. The respective color-separated images are then converted into electrical signals. These signals are then operated on to produce cyan, magenta, and yellow electrical signals. These signals are then transmitted to a thermal printer. To obtain the print, a cyan, magenta, or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta, and yellow signals. A color hard copy is thus obtained which corresponds to the original picture viewed on a screen. Further details of this process and an apparatus for carrying it out are set forth in U.S. Pat. No. 4,621,271 issued Nov. 4, 1986 to Brownstein, titled "Apparatus And Method For Controlling A thermal Printer Apparatus."

Thermal-dye-transfer receiving elements ("receivers") used in thermal-dye-transfer generally comprise a polymeric image-receiving layer coated on a support. Supports are required to have, among other properties, adequate strength, dimensional stability, and heat resistance. For reflective viewing, supports are also desired to be as white as possible. Cellulose paper and plastic films have been proposed for use as dye-receiving element supports in efforts to meet these requirements. Recently, microvoided films formed by stretching an orientable polymer containing an incompatible organic or inorganic material have been suggested for use in thermal dye-transfer receivers.

Thermal-dye-transfer receiving sheets for labels or stickers are known in the art including, for example, U.S. Pat. No. 6,153,558 issued Nov. 28, 2000 to Shirai et al., titled "Thermal Transfer Image-Receiving Sheet For Sticker And Method Of Manufacturing Same;" U.S. Pat. No. 6,162,517 issued Dec. 19, 2000 to Oshima et al., titled "Image-receiving Sheet For Thermal Transfer Printing;" and U.S. Pat. No. 4,984,823 issued Jan. 15, 1991 to Ishii et al., titled "Label Having Sublimation Transferred Image." U.S. Pat. No. 6,162,517 issued Dec. 19, 2000 to Oshima et al., titled "Image-receiving Sheet For Thermal Transfer Printing," for example, discloses a label comprising, disposed between a dye receptor layer and an adhesive layer, a foamed resin film layer and a non-foamed resin film layer. A bonding layer can be disposed between the foamed and non-foamed layers. U.S. Pat. No. 4,984,823 to Ishii et al. discloses a label portion comprising an image-receiving layer, a sheet substrate, and an adhesive layer. The sheet substrate can be a resin film such as foamed polyethylene terephthalate, synthetic paper, and the like.

There is a continuing need for high-quality labels that can be printed from digital label files that contain graphics, text, and images. Digital printing of labels takes advantage of the growing amount of label data that is resident in digital files. Digital printing, as opposed to the analog flexographic printing of labels, also enables the use of distributive printing of label files, which allows a digital label file to be created in one central location, sent to remote locations, and printed on digital label printers.

Although thermal-dye-transfer receivers for non-label applications have achieved high quality, the construction and nature of thermal dye-transfer media used for making labels are different. For example, labels are usually thinner than the media from which they are made. Thermal-dye transfer media can be more expensive than the media used in other printing techniques, thus making the development of new materials and structural configurations that are competitive for use in high-volume or low cost commercial applications a challenging endeavor.

PROBLEM TO BE SOLVED BY THE INVENTION

There is a need for pressure-sensitive labels for application to packages that are high in quality and at the same time economically competitive. There is a further need for the printing of the labels from digital information files that has a photographic-quality image.

SUMMARY OF THE INVENTION

It is an object of the invention to provide higher quality images to packaging materials.

It is a further object to provide a thermal-dye-transfer imaging system for making labels that have bright and sharp images.

It is a further object of the invention to provide labels that can be printed from digital files.

It is a further object of the invention to provide labels that are more amenable to the printing, if desired, of smaller runs (or lengths of labels continuously printed at one time, for example, less than 50 meters), relative to lithographic printing.

These and other objects of the invention are accomplished by thermal-dye-transfer labels, and pre-label media from which they are made, comprising an extruded pragmatic polymer film comprising a microvoided layer, a continuous phase of which comprises a polylactic-acid-based material.

In the pre-label media, the pragmatic polymer film is below a layer capable of receiving or having received an image, which image comprises dyes. Below the pragmatic polymer film is a lower strippable (i.e. peelable) carrier, wherein a pressure-sensitive adhesive layer is between said lower strippable carrier and the pragmatic polymer film. Optionally an environmental protection layer overlies the image-receiving layer. Preferably, the carrier comprises paper and has exposed edges where it has a greater surface area than the pragmatic pre-label sheet, the part of the pre-label media above the carrier. The image formed on the media optionally comprises fiducial marks. Optionally, an intermediate film can be located between the pragmatic polymer film and the adhesive layer.

The term "film" as used herein encompasses both single layer and multi-layer or composite structures.

In the labels made in accordance with the present invention, a "pragmatic label" or "face stock" comprises, from top to bottom, an image-receiving layer (typically imaged), a substrate comprising a pragmatic polymer layer, and an adhesive layer, but does not include the removable carrier layer from which it is separated before adhesively applying the pragmatic label to an objective body. A "pragmatic label" can be applied to the surface of an objective body such as a package, container, wall, card, vehicle, or any other object that comprises a generally smooth solid surface.

As used herein, the "substrate" of a pragmatic label, which substrate can comprise one or more layers, refers to the part of the label between the image receiving layer and the pressure-sensitive adhesive layer. Since, as indicated below, the pragmatic label may optionally comprise more than one adhesive layers, the latter adhesive layer will also be referred to as the "bottom adhesive layer."

The "substrate" can comprise one or more layers, including a pragmatic polymer film. The pragmatic polymer film is immediately under the image-receiving layer, or optionally separated by a subbing layer, and comprises a microvoided layer and any other coextruded layers other than the image-receiving layer. The pragmatic polymer film is optionally coextruded with the image-receiving layer.

As indicated above, a plurality of individual labels can be formed in media or sheets. The sheets or media used for printing will herein be referred to as integral-separable "pre-label media" or pre-label receiver sheets." Typically, after an image is formed on the media, one or more "pragmatic labels" or "label face stocks" are cut into the imaged media. The media, analogous to the individual label, comprise a carrier sheet, an adhesive layer, and a "pragmatic pre-label sheet" in which one or more individual pragmatic labels can be cut.

The term "sheet" will generically include both the receiver or media and the larger material from which such media can be made. The term "sheet" includes both single-page sheets and continuous webs or rolls. The term "label or pre-label element" includes generically a label, any media in which a label is formed, any media used for making a label, or any intermediate sheet used for making the media which at least includes the layers in the pragmatic label.

The one or more pragmatic labels cut in the pre-label receiver sheet (typically only to the depth of the pragmatic pre-label sheet), which labels can be cut into various shapes, form what is then referred to as a "pragmatic-label sheet," the bottom surface of which, like the pragmatic pre-label sheet before it, remains adhesively attached to the top surface of the carrier sheet which may be a common carrier-sheet for a plurality of labels, depending on the cutting operation. Each pragmatic label in a pragmatic-label sheet can be separated from the carrier sheet before applying it to decorate or otherwise label an object.

Typically, the pragmatic labels are cut from a pre-label receiver sheet that is imaged (forming an imaged pragmatic-label sheet adhesively attached to the carrier sheet), although it is possible to cut the pragmatic labels in the pre-label receiver sheet prior to imaging. The term "label" will refer to either imaged or un-imaged labels, as the case may be, unless specified otherwise.

Once a pragmatic label is formed in a pre-label receiver sheet, the pre-label receiver sheet is then referred to as integral-separable "label media" or "label sheet" comprising two components, a pragmatic-label sheet and a carrier sheet. Thus, a label sheet is an assembly that includes at least one pragmatic label (also referred to as a pragmatic label portion when part of a sheet) and at least one carrier sheet adhesively but separably attached to the bottom adhesive layer of the pragmatic label. The pragmatic label, in a label sheet, is thus integral with a separable or peelable carrier sheet. As indicated above, the pragmatic label is usually imaged in the label sheet but it is also possible to image the label at a later time.

Usually, the label media when completely constructed comprises a plurality of pragmatic labels that may be in frames as in U.S. Pat. No. 4,984,823, hereby incorporated by reference, or the label media may have any other arrangement advantageous to the particular circumstances of use.

In one embodiment of the invention, a pragmatic label is cut into a pre-label receiver sheet that is already imaged. The pre-label receiver sheet usually remains integral during imaging, although it is possible to image a pragmatic label, pragmatic label sheet, or an untackified form thereof, prior to joining it to a carrier sheet or after removing it from the carrier sheet. In another embodiment, a pragmatic label is cut into an unimaged pre-label receiver sheet that is later imaged.

The term "label" as used herein usually refers to a pragmatic label, either as part of label media, alone, or during use after being applied to an object, unless otherwise indicated by the context.

The term "untackified pragmatic label" refers to the pragmatic label excluding only the adhesive layer on the bottom side of the pragmatic label. Similarly, the "untackified pragmatic-label sheet" or "untackified pragmatic pre-label sheet will refer to a pragmatic label sheet or pre-label sheet excluding only the bottom adhesive layer.

The terms "carrier," "peelable carrier," "carrier sheet," "liner," "carrier stock," or the like refers to the part of the label or pre-label element separable from the face stock, which is under the bottom adhesive layer. As indicated above, the carrier can be designed to hold a single pragmatic label or to be common to a plurality of pragmatic labels.

In a typical embodiment, therefore, label media are dividable into two parts or "sides," an "upper side," consisting of the pragmatic-label sheet or face-stock sheet, and a "lower side" consisting of the carrier sheet, which two sides are most typically divided after imaging and before applying the pragmatic label to an objective body.

The carrier can comprise a multilayer sheet, including a release layer adjacent the adhesive layer of the upper side. As indicated below, the bottom adhesive layer, under the pragmatic label sheet or pragmatic pre-label sheet, can be formed in various ways. For example, the adhesive layer can be coated onto the bottom of an untackified pre-label sheet, it can be coated on the bottom of a laminate that is applied to the rest of the pragmatic pre-label sheet, or it can be coated on top of a laminate forming a portion or the whole of the peelable carrier which is then applied to the pragmatic pre-label sheet.

The terms "top," "upper," "and "face," of the label, label media, or a precursor thereof, mean the side or towards the side of a label or label media or related structure bearing the imaging layer or image. The terms "bottom," "lower side," and "back" mean the side or towards the side of the label or label media or related structure, or precursor thereof, opposite from the side bearing the image or imaging layer. The term "environmental protection layer" or "protective overcoat" means a substantially transparent layer applied over the fully imaged dye-receiving layer on a label or label receiver sheet.

ADVANTAGEOUS EFFECT OF THE INVENTION

The invention provides labels having improved image quality, including more realistic flesh tones, for packaging materials. The invention includes a printing method that can print text, graphics and images using optical digital printing systems in combination with a pressure-sensitive label for packaging.

DETAILED DESCRIPTION OF THE INVENTION

A pragmatic label according to the invention comprises, in order, a polymeric image-receiving layer, a pragmatic polymer film, and an adhesive layer. Such a label is typically made using pre-label media in which labels are formed in an integral-separable label media comprising pragmatic label sheets attached to carrier sheets.

In the following description, the various "layers" can refer to layers forming either individual labels, label media in which a plurality of labels are formed, pre-label media used for making a plurality of labels, webs used to make a plurality of pre-label media, or intermediate structures thereof.

A pragmatic pre-label sheet for making pre-label media can be made in various ways. In one preferred embodiment, a polymeric image-receiving layer is coextruded with a pragmatic polymer film, either a single or composite film, by the following steps.

First, a first melt for a polymeric image-receiving layer is coextruded with one or more other melts that form a single-layer or multiple-layer "pragmatic polymer film," wherein the other melts includes at least a second melt comprising an orientable thermoplastic polymeric material comprising a polylactic acid based material and a void initiator for forming a microvoidable layer, thereby forming a cast composite film comprising at least two layers, an image-receiving layer and the microvoidable layer.

Second, the cast composite film is stretched in at least one direction to reduce the thickness of the layers in the composite film and to produce an oriented composite film, wherein the image-receiving layer is less than 15 micrometers and the thickness is preferably 1 to 5 μm. Third, an optional intermediate sheet, comprising one or more layers, is optionally applied to the back surface of the stretched composite film. The intermediate sheet, for example, can be non-voided poly(lactic acid) or polyester such as poly(ethylene terephthalate) to provide further support to the pragmatic label during use. Other polymers, however, including polyolefins, can be used which, however, may require a subbing layer for laminating it to the pragmatic polymer layer.

Third, a pressure-sensitive adhesive layer, or a laminate comprising a pressure-sensitive adhesive layer, is applied to at least a portion of the back surface side, preferably the entire side, of the stretched composite film or cut portions thereof, on the side opposite the image-receiving layer, to form a pragmatic pre-label sheet. Alternatively, when an intermediate sheet is present, a pressure-sensitive adhesive layer, or a laminate comprising a pressure-sensitive adhesive layer, can be applied to at least a portion of the back surface of the intermediate sheet, to form a pragmatic pre-label sheet.

This so-called "pragmatic pre-label sheet," or cut portions thereof, can then be provided with a carrier sheet such that the adhesive layer of the pragmatic pre-label is covered with the carrier sheet in peelable adhesion, thereby forming an integral-separable "pre-label receiver sheet" which may be used, optionally cut into smaller sized sheets, as pre-label receiver media. Subsequently, at least one shape can be cut into at least the pragmatic pre-label sheet of a pre-label receiver sheet, before or after imaging of the receiver sheet, to form at least one pragmatic label in the receiver sheet, thereby forming an integral-separable label receiver sheet comprising a pragmatic-label sheet attached to a carrier sheet.

In one embodiment, when the carrier sheet is laminated to the pragmatic pre-label sheet, a front surface of the carrier sheet faces the back surface of the pragmatic pre-label sheet. Preferably, at least one pragmatic-label portion is formed in the pragmatic-label sheet by cutting a shape through the pragmatic pre-label sheet but not through the carrier sheet.

In a preferred embodiment, the pre-label receiver media are made by co-extruding a first melt for a polymeric image-receiving layer with one or more other melts for forming a single-layer or multiple-layer pragmatic polymer film, wherein the other melts includes a second melt comprising a continuous phase polymer matrix comprising a polylactic-acid-based material having dispersed therein crosslinked inorganic or organic particles or microbeads, and a third melt comprising a voided or non-voided thermoplastic material, thereby forming a cast composite film comprising at least said three layers, followed by stretching in at least one direction the cast composite film to reduce the thickness of the layers in the composite film and to produce an oriented composite film. The composite film, in order, comprises as the first layer an image-receiving layer, as the second layer a microvoided compliant layer, and as a third layer a microvoided or non-voided underlayer. In still another preferred embodiment, a fourth melt can be coextruded such that the microvoided layer is between the layers formed from the third and fourth melts.

In another preferred embodiment, the pragmatic pre-label sheet consists essentially of only coextruded layers above the pressure-sensitive adhesive layer. In other words, the image-receiving layer and the pragmatic polymer sheet provide the only layers in the untackified pragmatic label or untackified pragmatic pre-label sheet. Alternatively, the image-receiving layer can be solvent coated on the pragmatic polymer film, either with or without an intermediate subbing layer. Subbing layers are typically relatively thinner compared to the other layers of the sheet, for example, substantially thinner than the image-receiving layer.

The peelable carrier can be laminated over the pressure-sensitive adhesive. (The terms peelable, removable, and strippable are herein used synonymously and interchangeably to indicate that the carrier is designed to be easily and readily separated from the label to which it is attached.) Alternately, the pressure-sensitive adhesive layer can be coated onto a peelable carrier to form a pressure-sensitive adhesive transfer sheet, wherein the transfer sheet is laminated to the back side of the stretched composite film, or smaller cut part thereof, such that the adhesive and carrier are applied simultaneously in forming the pre-label receiver sheet. The carrier sheet, however, can comprise more than one layer and the layers of the carrier sheet can be applied, in forming the pre-label receiver sheet, in more than one step.

In one embodiment, cutting lines are formed at least partially through the integral-separable label receiver media, so to allow peeling of at least one pragmatic label portion comprising a portioned (a) imaged image-receiving layer, (b) substrate, and (c) bottom pressure-sensitive adhesive layer, wherein the substrate consists of all the layers, including the portioned (i) pragmatic polymer layer and (ii) optional intermediate sheet, between the image-receiving layer and the bottom pressure-sensitive layer. In another embodiment, the integral-separable label receiver sheet comprises a multiple number of pragmatic-label portions, and cutting lines are formed through the pragmatic-label portions but not through the carrier sheet. As indicated above, the multiple pragmatic-label portions in the pragmatic label sheet can be formed by sectioning the sheet into a plurality of contiguous frames each forming a separable pragmatic label. Alternatively, the pragmatic-label portions can be formed into isolated imaged areas.

During imaging of the pre-label media, at least one dye image, optionally a plurality of dye-images, are formed on the image-receiving layer. A sublimation transferred image can be formed in said image-receiving layer by transferring a sublimable dye from a colorant layer of a heat transfer sheet, also referred to as a dye-donor element. Preferably, the print density of the image is at least 1.5, more preferably at least 2.0.

The invention is also directed to integral-separable label media each comprising at least one imaged or unimaged pragmatic-label portion. Finally, the present invention is also directed to an imaged or unimaged pragmatic label, before or after being separated from a carrier or remaining label receiver sheet and before or after being adhesively applied to an object.

The invention has numerous advantages over prior practices in the art. Recently there has been a trend in the marketing of mass consumer items to try to localize the marketing to separately approach smaller groups. These groups may be regional, ethnic, gender, age, or special interest differentiated. In order to approach these different groups, there is a need to provide packaging that is specifically directed to these groups. As discussed above, the traditional packaging materials are generally suited for very long runs of material and to form shorter runs or to provide rapid changes in packaging is impossible or very expensive. By means of the present invention, thermal-dye-transfer materials are rendered more suitable for packaging uses. Further, recently there has become available rapid thermal-dye-transfer apparatus suitable for short runs of material. The combination of a low cost label material with the processing apparatus available for rapid short and long runs of material has resulted in an increased opportunity for thermal-dye-transfer material to be utilized as labels in packaging materials. In accordance with the present process, low-cost thermal-dye-transfer labels can be made that have excellent properties for packaging including high-quality imaging and the ability to print from a digital file.

The labels made by the present process are also capable of having brighter, sharper, and higher color images, than anything presently available in packaging by prior-art printing techniques. Thermal-dye-transfer imaging can provide superior flesh tones. The labels have the advantage of superior image and are available on thin base materials which are low in cost while providing superior opacity and strength. Furthermore, the invention allows packages to be rapidly designed and brought to market. For instance, significant events in sports or entertainment may be brought to market, almost instantly, as a digital image. The digital image may be immediately printed onto pressure sensitive labels and utilized within moments from the time of the event. This is in contrast to typical photogravure or flexographic imaging where lead times for pressure-sensitive labels are typically several weeks. Further, the quality of the formed image lends itself to collectable images formed as a part of packaging much better than previous images that were of lower quality and were less desirable for collecting. Finally, the regional customization of images is rapidly possible.

The ability to rapidly change packaging also would find use in the need to provide regional labeling with different languages and marketing themes in different countries. Different countries have different legal labeling requirements as to content. For instance, alcoholic beverages such as wine and beer are subject to a wide variety of regional and national variations in labeling requirements. Wines manufactured in France may have long delays in shipping out of France due to the wait for national labeling in other countries. Photographic-quality images also would be particularly desirable for premium products such as fine wines, perfumes, and chocolates, as they would be of high quality and reflect the high quality of the product in the package. The invention provides a printing method that is economically viable when printing short runs as the cost of printing plates or printing cylinders are reduced.

Thermal-dye-transfer image technology can simultaneously print text, graphics, and photographic quality images on the pressure sensitive label. Since the thermal-dye-transfer imaging of the invention are both optically and digitally compatible, text, graphics, and images can be printed using known digital printing equipment such as lasers and CRT printers. Because the thermal-dye-transfer system is digitally compatible, each package can contain different data enabling customization of individual packages without the extra expense of printing plates or cylinders. Further, printing digital files allows the files to be transported using electronic data transfer technology such as the internet thus reducing the cycle time to apply printing to a package. Thermal-dye-transfer imaging allows competitive printing speeds compared to current inkjet. These and other advantages will be apparent from the detailed description below.

Furthermore, in the field of product labeling and advertising, the ability of the printing technology to reproduce all of the colors in the Pantone color space is important. An example is the reproduction of corporate colors such as candy apple reds or lemon yellows that uniquely identify a product. Prior art printed ink systems for labeling have utilized spot colors beyond red, green, and blue inks to obtain the desired color. Thermal-dye-transfer printing systems are typically Pantone color space limited when the thermal dye transfer uses only combinations of yellow, magenta, and cyan dyes to form colors. (Thermal printing has the advantage that additional color patches, including white or fluorescent colors can be used to improve the color space.) At present, approximately 70% of Pantone color space can be replicated with a yellow, magenta, and cyan dye based system. As another option, additional color may be applied to the printed, developed thermal-dye-transfer formed image or additional color may be under the dye receiving layer, so that the image can comprise areas of both dye transfer image and areas colored, as background, without thermal dye transfer (uncovered by thermal-dye-transfer dyes) in order to improve the gamut of the image.

Thus, one preferred method of providing an expanded thermal-dye-transfer dye gamut is providing a non-neutral color to a layer under the dye-receiving layer, which non-neutral color will show through the transparent dye-receiving layer. By providing non-neutral, or a colored background to or near the top of the substrate of the label, a single color background can be utilized under the thermal-dye-transfer image of the invention. Further, because the dyes utilized in thermal-dye-transfer imaging printing systems are semi-transparent, background color can optionally be blended with color formed by thermal-dye-transfer dyes. An example of a colored background would be the addition of a candy apple red tint to a top layer of the substrate, adjacent the dye receiving layer, preferably in or near the top of the pragmatic polymer sheet. By forming a thermal-dye-transfer image on top of the candy apple red base, the dye gamut of the thermal-dye-transfer "system" is expanded to include candy-apple red. The background color becomes part of the image by not applying the thermal-dye-transfer dye in certain intended or preselected areas and the background color can be eliminated by applying preselected one or more thermal-dye-transfer imaging dyes over the background.

Another preferred method for the expansion of the thermal-dye-transfer color space is by printing and developing the thermal-dye-transfer image and subsequently printing color on top of the thermal-dye-transfer formed image. This method is preferred as printing inks common to the printing industry can be used to expand the color gamut of the thermal-dye-transfer formed image. Over printing with dye-based inks allow color formation with the thermal-dye-transfer formed dyes thus expanding the color space of the thermal-dye-transfer dyes. Over printing with pigmented inks, create expanded color without utilizing the native colors of the thermal-dye-transfer formed image below the pigment printing ink. Overprinting can occur by lithographic, inkjet, or other printing technologies.

In another embodiment, the base material preferably is printed with indicia. By printing the base material with indicia, the text size limitation of thermal dye transfer is overcome as printed text is legible to 2 points. Further, by printing black text on the base material, the thermal-dye-transfer imaging system utilized for printing can be low contrast which significantly improves flesh tones. Improved flesh tones, especially on advertising labels has significant commercial value as flesh tones comprising printed inks, characteristic of lithographic printing, are low in quality.

The addition of a fiducial mark to the thermal-dye-transfer formed image is preferred as the fiducial mark provides a means for die cutting the image to create a label. The addition of a fiducial mark allows the article to be die cut using optical sensors to read the registration of the image. The fiducial mark may be printed on the base material, printed using thermal-dye-transfer formed images, or post process printed using printed inks. In another embodiment, the fiducial mark is created utilizing a mechanical means such as punched hole, mechanical embossing, or a partial punched hole to create a topographical difference in the thermal dye transferred formed image. A mechanical fiducial mark allows for mechanical sensors to be used for die cutting, application of a spot printed color, or for locating a label on a package during automated labeling.

In another embodiment of the invention, the thermal-dye-transfer formed image is preferably over laminated with a pre-printed sheet. By pre-printing an over-lamination sheet with images, text, or non-neutral color, the color space of the thermal-dye-transfer formed image is expanded. Further, over laminating also protects the delicate thermal-dye-transfer formed image from abrasion, water, and handling damage that frequently occurs for packaging labels.

Suitable printing inks for this invention to expand the color gamut of a thermal-dye-transfer system include solvent based inks and radiation cured inks. Examples of solvent based inks include nitrocellulose maleic, nitrocellulose polyamide, nitrocellulose acrylic, nitrocellulose urethane, chlorinated rubber, vinyl, acrylic, alcohol soluble acrylic, cellulose acetate acrylic styrene, and other synthetic polymers. Examples of radiation cured inks include ultraviolet and electron beam inks. The preferred ink systems for printing indicia are radiation cured inks because of the need to reduce volatile organic compounds associated with solvent based ink systems.

In order to produce a pressure sensitive label with expanded color gamut, the liner material that carries the pressure sensitive adhesive, face stock, and thermal-dye-transfer imaged layers, must allow for efficient transport in manufacturing, image printing, image development, label converting, and label application equipment. A label comprising a thermal-dye-transfer imaging layer, a base, and a strippable liner, adhesively connected by an adhesive to said base, wherein said base has a stiffness of between 15 and 60 millinewtons and an L* is greater than 92.0, and wherein said liner has a stiffness of between 40 and 120 millinewtons is preferred.

A peelable liner or back is preferred as the pressure sensitive adhesive required for adhesion of the label to the package can not be transported through labeling equipment without the liner. The liner provides strength for conveyance and protects the pressure sensitive adhesive prior to application to the package. A preferred liner material is cellulose paper. A cellulose paper liner is flexible, strong and low in cost compared to polymer substrates. Further, a cellulose paper substrate allows for a textured label surface that can be desirable in some packaging applications. The paper may be provided with coatings that will provide waterproofing to the paper as the label element of the invention must be processed in aqueous chemistry to develop the image. Examples of suitable water proof coatings applied to the paper are acrylic polymer, melt extruded polyethylene, and oriented polyolefin sheets laminated to the paper. Paper is also preferred as paper can contain moisture and salt which provide antistatic properties that prevent static sensitization of the thermal-dye-transfer image layers.

Another preferred liner material or peelable back is an oriented sheet of polymer. The liner preferably is an oriented polymer because of the strength and toughness developed in the orientation process. Preferred polymers for the liner substrate include polyolefins, polyester, and nylon. Preferred polyolefin polymers include polypropylene, polyethylene, polymethylpentene, polystyrene, polybutylene, and mixtures thereof. Polyolefin copolymers, including copolymers of propylene and ethylene such as hexene, butene, and octene are also useful. Polyester is most preferred, as it has desirable strength and toughness properties required for efficient transport of thermal-dye-transfer pressure sensitive label liners in high speed labeling equipment.

In another preferred embodiment, the liner consists of a paper core to which sheets of oriented polymer are laminated. The laminated paper liner is preferred because the oriented sheets of polymer provide tensile strength which allows the thickness of the liner to be reduced compared to coated paper and the oriented polymer sheet provides resistance to curl during manufacturing and drying in the thermal-dye-transfer process.

The tensile strength of the liner or the tensile stress at which a substrate breaks apart is an important conveyance and forming parameter. Tensile strength is measured by ASTM D882 procedure. A tensile strength greater than 120 MPa is preferred as liners less than 110 MPa begin to fracture in automated packaging equipment during conveyance, forming, and application to the package.

The coefficient of friction or COF of the liner bearing the thermal-dye-transfer imaging layer is an important characteristic as the COF is related to conveyance and forming efficiency in automated labeling equipment. COF is the ratio of the weight of an item moving on a surface to the force that maintains contact between the surface and the item. The mathematical expression for COF is as follows:

$$COF=\mu=(\text{friction force}/\text{normal force})$$

The COF of the liner is measured using ASTM D-1894 utilizing a stainless steel sled to measure both the static and dynamic COF of the liner. The preferred COF for the liner of the invention is between 0.2 and 0.6. As an example, a 0.2 COF is necessary for coating on a label used in a pick-and-place application. The operation using a mechanical device to pick a label and move it to another point requires a low COF so the label will easily slide over the surface of the label below it. At the other extreme, large sheets such as book covers require a 0.6 COF to prevent them from slipping and sliding when they are piled on top of each other in storage. Occasionally, a particular material may require a high COF on one side and a low COF on the other side. Normally, the base material itself, such as a plastic film, foil, or paper substrate, would provide the necessary COF for one side. Application of an appropriate coating would modify the image side to give the higher or lower value. Conceivably, two different coatings could be used with one on either side. COF can be static or kinetic. The coefficient of static friction is the value at the time movement between the two surfaces is ready to start but no actual movement has occurred. The coefficient of kinetic friction refers to the case when the two surfaces are actually sliding against each other at a constant rate of speed. COF is usually measured by using a sled placed on the surface. The force necessary at the onset of sliding provides a measurement of static COF. Pulling the sled at a constant speed over a given length provides a measure of kinetic frictional force.

The preferred thickness of the liner of the invention is between 75 and 225 micrometers. Thickness of the liner is important in that the strength of the liner, expressed in terms of tensile strength or mechanical modulus, must be balanced with the thickness of the liner to achieve a cost efficient design. For example, thick liners that are high in strength are not cost efficient because thick liners will result in short roll lengths compared to thin liners at a given roll diameter. A liner thickness less that 60 micrometers has been shown to cause transport failure in the edge guided thermal-dye-transfer printers. A liner thickness greater than 250 micrometers yields a design that is not cost effective and is difficult to transport in existing thermal-dye-transfer printers.

The thermal-dye-transfer imaging is preferably applied to a label prior to application to a package. The flexible substrate of the label contains the necessary tensile strength properties and coefficient of friction properties to allow for efficient transport and application of the images in high speed labeling equipment. The face stock is supported and transported through labeling equipment using a tough liner material.

Because the thermal-dye-transfer imaging layer is vulnerable to environmental solvents such as water, coffee, and hand oils, an environmental protection layer is preferably applied to the thermal-dye-transfer imaging layer after imaging. The environmental protection layer should be clear, i.e., transparent, and is preferably colorless. But it is specifically contemplated that the environmental protection layer can have some color for the purposes of color correction, or for special effects, so long as it does not detrimentally affect the formation or viewing of the image through the overcoat. Thus, there can be incorporated into the polymer, dyes that will impart color. In addition, additives can be incorporated into the polymer that will give to the overcoat, desired properties. Examples of protective overcoat materials are well known in the art of thermal-dye-transfer imaging.

The materials used in making the labels according to the present invention will now be described in greater detail. As indicate above, the dye-receiving layer in the pre-label receiver sheet is any layer that will serve the function of receiving the dye transferred from a dye donor. Suitably it comprises a polymeric binder containing a polyester or a polycarbonate or a combination thereof. A desirable combination includes the polyester and polycarbonate polymers in a weight ratio of from 0.8 to 4.0:1. Underneath the dye-receiving layer is a pragmatic polymer sheet which comprises a microvoided layer.

In one preferred embodiment, the microvoided layer contains a continuous phase comprising a polylactic-acid-based material having dispersed therein a mixture of void initiators, said layer having a void volume of at least 25% by volume. Optionally, beneath the microvoided layer is an underlayer comprised of a voided or non-voided polylactic-acid-based material.

A function of the microvoided layer provides more compliant properties to the receiver. This is important as it impacts the degree of contact to the thermal head during printing. Higher compliance results in better contact and higher dye transfer efficiency due to improved thermal transfer.

In one embodiment of a label structure, for example, beneath the dye-image receiving layer there is a microvoided layer beneath which there is a second microvoided layer comprised of a second polylactic-acid-based material having dispersed therein void initiators. This composite comprising the two microvoided layers can be coated, on the side opposite the image receiving layer, with an adhesive composition or laminated to a material comprising such a coating, to form the pragmatic pre-label sheet.

In an alternative embodiment, beneath the microvoided layer, there is a layer comprised of a non-voided polylactic-acid-based material. The composite film comprising these two layers, in addition to the dye-image receiving layer, is then (on the side opposite the image receiving layer) coated with an adhesive composition, or laminated to a material comprising such a coating, to form the pragmatic pre-label sheet.

The term voids or microvoids means pores formed in an oriented polymeric film during stretching as the result of a void-initiating particle. In the preferred embodiment, these pores are initiated by either inorganic particles, crosslinked organic microbeads and/or non-crosslinked polymer particles. The term "microbead" means synthesized polymeric spheres which, in the present invention, are crosslinked.

The label or pre-label elements in accordance with the present invention, therefore, comprise a single-layer or multi-layer film comprising, as at least one layer, a microvoided layer comprising a polylactic-acid-based material in a continuous phase. Preferably, inorganic particles having an average diameter in the range of 0.1 to 1.0 micrometers are used as microvoiding agents. It is especially advantageous for the average diameter of the particles to be in the range of 0.1 to 0.6 micrometers. Preferably, such single-layer and multi-layer films are extruded as a single layer or multi-layer, respectively. It is also advantageous for the extruded or co-extruded layers to be sequentially stretched, first in the machine direction and then in the transverse direction.

The polylactic-acid-based material used in the present invention comprises a polylactic-acid-based polymer including polylactic acid or and copolymers comprising compatible comonomers such as one or more hydroxycarboxylic acids. Exemplary hydroxycarboxylic acid includes glycolic acid, hydroxybutyric acid, hydroxyvaleric acid, hydroxypentanoic acid, hydroxycaproic acid, and hydroxyheptanoic acid. The polylactic-acid-based material preferably comprises 85 to 100% by weight of a polylactic-acid-based polymer (or PLA-based polymer). The PLA-based polymer preferably comprises from 85 to 100 mol % of lactic-acid units (preferably derived from L-lactic acid) and optionally polymerization compatible with other comonomers. Preferably, the PLA-based polymer comprises at least 85 mole percent, more preferably at least 90 mole percent, most preferably at least 95 mole percent of lactic-acid monomeric units whether derived from lactic acid monomers or lactide dimers.

Polylactic acid, also referred to as "PLA," used in this invention includes polymers based essentially on single D- or L-isomers of lactic acid, or mixtures thereof. In a preferred embodiment, PLA is a thermoplastic polyester of 2-hydroxy lactate (lactic acid) or lactide units. The formula of the unit is: —[O—CH($CH_3$)—CO]—. The alpha-carbon of the monomer is optically active (L-configuration). The polylactic-acid-based polymer is typically selected from the group consisting of D-polylactic acid, L-polylactic acid, D,L-polylactic acid, meso-polylactic acid, and any combination of D-polylactic acid, L-polylactic acid, D,L-polylactic acid, and meso-polylactic acid. In one embodiment, the polylactic acid-based material includes predominantly PLLA (poly-L-lactic acid). In one embodiment, the number average molecular weight is between about 15,000 and about 1,000,000.

The various physical and mechanical properties vary with change of racemic content, and as the racemic content increases, the PLA becomes amorphous, as described, for example, in U.S. Pat. No. 6,469,133, the contents of which are hereby incorporated by reference. In one embodiment, the polymeric material includes relatively low (less than about 5%) amounts of the racemic form of the polylactic acid. When the PLA content rises above about 5% of the racemic form, the amorphous nature of the racemic form may alter the physical and/or mechanical properties of the resulting material.

Additional polymers can be added to the polylactic-acid-based material so long as they are compatible with the polylactic-acid-based polymers. In one embodiment, compatibility is miscibility (defined as one polymer being able to blend with another polymer without a phase separation between the polymers) such that the polymer and the polylactic-acid-based polymer are miscible under conditions of use. Typically, polymers with some degree of polar character can be used. Suitable polymeric resins that are miscible with polylactic acid to some extent can include, for example, polyvinyl chloride, polyethylene glycol, polyglycolide, ethylene vinyl acetate, polycarbonate, polycaprolactone, polyhydroxyalkanoates (polyesters), polyolefins modified with polar groups such as maleic anhydride and others, ionomers, e.g. SURLYN® (DuPont Company), epoxidized natural rubber, and other epoxidized polymers.

In one particular embodiment of the present invention, a polylactic acid comprises a mixture of at least 90%, preferably about 96% poly(L-lactic acid) and at least 15%, preferably about 4% poly(D-lactic acid), which is preferable from the viewpo int processing durability.

To the polylactic-acid-based material, various kinds of known additives, for example, an oxidation inhibitor, or an antistatic agent may be added by a volume which does not destroy the advantages according to the present invention. As mentioned above, the polylactic-acid-containing layer can include up to 15 weight percent of additional polymers or blends of other polyesters in the continuous phase. Optionally, chain extenders can be used for the polymerization, as will be understood by the skilled artisan. Chain extenders include, for example, higher alcohols such as lauryl alcohol and hydroxy acids such as lactic acid and glycolic acid.

The polylactic-acid-containing microvoided layer can comprise one or more thermoplastic polylactic-acid-based polymers (including polymers comprising individual isomers or mixtures of isomers), which layer has been biaxially stretched (that is, stretched in both the longitudinal and transverse directions) to create the microvoids therein around void initiating particles. Any suitable polylactic acid or polylactide can be used as long as it can be cast, spun, molded, or otherwise formed into a film or sheet, and can be biaxially oriented as noted above. Generally, the polylactic acids have a glass transition temperature of from about 55 to about 65° C. (preferably from about 58 to about 64° C.) as determined using a differential scanning calorimeter (DSC).

Suitable polylactic-based polymers can be prepared by polymerization of lactic acid or lactide and comprise at least 50% by weight of lactic acid residue repeating units (including lactide residue repeating units), or combinations thereof. These lactic acid and lactide polymers include homopolymers and copolymers such as random and/or block copolymers of lactic acid and/or lactide. The lactic acid residue repeating monomer units may be obtained from L-lactic acid, D-lactic acid, by first forming L-lactide, D-lactide, or LD-lactide, preferably with L-lactic acid isomer levels up to 75%. Examples of commercially available polylactic acid polymers include a variety of polylactic acids that are available from Chronopol Inc. (Golden, Colo.), or polylactides sold under the trade name EcoPLA®. Further examples of suitable commercially available polylactic acid are Natureworks® from Cargill Dow, Lacea® from Mitsui Chemical, or L5000 from Biomer. When using polylactic acid, it may be desirable to have the polylactic acid in the semi-crystalline form.

Polylactic acids may be synthesized by conventionally known methods such as a direct dehydration condensation of lactic acid or a ring-opening polymerization of a cyclic dimer (lactide) of lactic acid in the presence of a catalyst. However, polylactic acid preparation is not limited to these processes. Copolymerization may also be carried out in the above processes by addition of a small amount of glycerol and other polyhydric alcohols, butanetetracarboxylic acid and other aliphatic polybasic acids, or polysaccharide and other polyhydric alcohols. Further, molecular weight of polylactic acid may be increased by addition of a chain extender such as diisocyanate. Compositions for polylactic-acid-based polymers are also disclosed in U.S. Pat. No. 5,405,887, hereby incorporated by reference.

As indicated above, at least one layer in the label or pre-label elements according to the present invention have a continuous polylactic-acid-containing phase. Dispersed within that continuous phase is a second phase comprised of microvoids which can contain inorganic particles, typically as void initiators. The polylactic acid and microvoids can be provided and generated as described below. The size of the void initiating particles which initiate the voids upon stretching should have an average particle size of typically 0.1 to 5.0 μm, most usually 0.3 to 2.0, and desirably 0.5 to 1.5 μm. Average particle size is that as measured by a Sedigraph® 5100 Particle Size Analysis System (by PsS, Limited). Preferred void initiating particles are inorganic particles, including but not limited to, barium sulfate, calcium carbonate, zinc sulfide, titanium dioxide, silica, alumina, and mixtures thereof, etc. Barium sulfate, zinc sulfide, or titanium dioxide are especially preferred.

As mentioned above, when used in the pragmatic polymer sheet, the microvoided layer can be part of a single-layer or multi-layer film. A second layer in the substrate can be, for example, a voided or non-voided polylactic acid-containing layer adjacent to and integral with the microvoided layer. When directly under the image-receiving layer, optionally with a tie layer, it can act as a compliant layer to improve optical density (OD).

In a preferred embodiment, the pragmatic pre-label sheet comprises at least one other layer that is arranged adjacent the polylactic-acid-containing layer. This additional polymer layer(s) can be co-extruded with the polylactic acid-containing layer or adhered to it in a suitable manner. Any suitable film-forming polymer (or mixture thereof) can be used in the additional polymer layer(s). The polymer in the adjacent layer can be any suitable material that provides a continuous film, including a polyester or polylactic acid.

In one embodiment, a second voided or unvoided polylactic-acid-containing layer is adjacent to said polylactic acid-containing microvoided layer. The two layers may be integrally formed using a co-extrusion or extrusion coating process. The polylactic acid of the second voided layer can be any of the polylactic acids described previously for the inorganic particle voided layer.

It is possible for the voids of this second voided layer or the microvoided layer to be formed by, instead of particles, by finely dispersing a polymer incompatible with the matrix polylactic-acid-based material and stretching the film uniaxially or biaxially. (It is also possible to have mixtures of particles and incompatible polymers.) When the film is stretched, a void is formed around each particle of the incompatible polymer. Since the formed fine voids operate to diffuse a light, the film is whitened and a higher reflectance can be obtained. The incompatible polymer is a polymer that does not dissolve into the polylactic acid.

Examples of such an incompatible polymer include poly-3-methylbutene-1, poly-4-methylpentene-1, polypropylene, polyvinyl-t-butane, 1,4-transpoly-2,3-dimethylbutadiene, polyvinylcyclohexane, polystyrene, polyfluorostyrene, cellulose acetate, cellulose propionate, and polychlorotrifluoroethylene. Among these polymers, polyolefins such as polypropylene are suitable.

The present invention does not require but permits the use or addition of various organic and inorganic materials such as colored pigments, anti-block agents, antistatic agents, plasticizers, dyes, stabilizers, nucleating agents, and other addenda known in the art to the microvoided layer. These materials may be incorporated into the polylactic-acid based material or they may exist as separate dispersed phases and can be incorporated into the polylactic-acid-based material using known techniques.

The microvoided polylactic-acid-containing layer can have levels of voiding, thickness, and smoothness adjusted to provide optimum stiffness and gloss properties. The polylactic acid-containing layer can also provide stiffness to the media and physical integrity to other layers. The thickness of the microvoided polylactic acid layer, after stretching is preferably about 5 to 15 micrometers, depending on the required stiffness of the element.

Optionally, the microvoided polylactic-acid-containing layer contains voids that are interconnected or open-celled in structure as disclosed in commonly assigned copending U.S. application Ser. No. 10/722,887, filed Nov. 26, 2003, by Thomas M. Laney et al., and titled, "POLYLACTIC-ACID-BASED SHEET MATERIAL AND METHOD OF MAKING," hereby incorporated by reference in its entirety.

Voids in the microvoided polylactic-acid-containing layer may be obtained by using void initiators in the required amount during its fabrication. Such void initiators may be inorganic fillers, as described above, or polymerizable organic materials. The void initiators may be employed in an amount of 30–50% by volume in the feed stock for the microvoided polylactic-acid-containing layer prior to extrusion and microvoiding.

Although organic microbeads or particles as well as inorganics can be used as void initiators, inorganics have the significant advantage, as shown below. Furthermore, the polylactic-acid based material allows for inorganics to be used in sequential stretch process whereas polyester does not. Another advantage of the smaller particles is improved gloss with smaller sized particles, typically inorganic particles.

Typical polymeric organic materials for microbeads, if used as void initiators, include polystyrenes, polyamides, fluoro polymers, poly(methyl methacrylate), poly(butyl acrylate), polycarbonates, or polyolefins.

The polylactic acid-containing layer used in this invention may be made on readily available film formation machines such as employed with conventional polyester materials. The pragmatic polymer film is preferably prepared in one step in which the microvoided polylactic acid layer can be monoextruded or coextruded and stretched. This one-step formation process leads to low manufacturing cost.

The process for adding the inorganic particle or other void initiator to the polylactic-acid-based matrix is not particularly restricted. The particles can be added in an extrusion process utilizing a twin-screw extruder.

A process for producing a preferred embodiment of a pragmatic polymer film according to the present invention will now be explained. However, the process is not particularly restricted to the following one.

Inorganic particles can be mixed into polylactic-acid-based material in a twin screw extruder at a temperature of 170–250° C. This mixture is extruded through a strand die, cooled in a water bath, and pelletized. The pellets are then dried at 50° C. and fed into an extruder "A."

The molten film delivered from the die is cooled and solidified on a drum having a temperature of 40–60° C. while applying either an electrostatic charge or a vacuum. The film is stretched in the longitudinal direction at a draw ratio of 2–5 times during passage through a heating chamber at a temperature of 70–90° C. Thereafter, the film is introduced into a tenter while the edges of the film are clamped by clips. In the tenter, the film is stretched in the transverse direction in a heated atmosphere having a temperature of 70–90° C. Although both the draw ratios in the longitudinal and transverse directions are in the range of 2 to 5 times, the area ratio between the non-stretched sheet and the biaxially stretched film is preferably in the range of 9 to 20 times. If the area ratio is greater than 20 times, a breakage of the film is liable to occur. Thereafter, the film is uniformly and gradually cooled to a room temperature, and wound.

Inorganic particles are incorporated into the continuous polylactic acid phase as described below. These particles comprise from about 25 to about 75 weight % (preferably from about 35 to about 65 weight %) of the total microvoided layer.

The inorganic particles can be incorporated into the continuous polylactic-acid phase by various means. For example, they can be incorporated during polymerization of the lactic acid or lactide used to make the continuous first phase. Alternatively and preferably, they are incorporated by mixing them into pellets of polylactic acid and extruding the mixture to produce a melt stream that is cooled into the desired sheet containing inorganic particles dispersed within the microvoids.

These inorganic particles are at least partially bordered by voids because they are embedded in the microvoids distributed throughout the continuous polylactic acid first phase. Thus, the microvoids containing the inorganic particles comprise a second phase dispersed within the continuous polylactic acid first phase. The microvoids generally occupy from about 25 to about 65% (by volume) of the microvoided layer.

The microvoids can be of any particular shape, that is circular, elliptical, convex, or any other shape reflecting the film orientation process and the shape and size of the inorganic particles. The size and ultimate physical properties of the microvoids depend upon the degree and balance of the orientation, temperature and rate of stretching, crystallization characteristics of the polylactic acid, the size and distribution of the void initiators or particles, and other considerations that would be apparent to one skilled in the art. Generally, the microvoids are formed when the extruded film containing preferably inorganic particles is biaxially stretched using conventional orientation techniques.

Thus, in one preferred embodiment, the polylactic-acid-containing layer used in the practice of this invention can be prepared by:

(a) blending inorganic particles into a desired polylactic-acid-based material as the continuous phase;

(b) forming a film comprising the polylactic-acid-based material containing inorganic particles by extrusion; and (c) stretching the sheet in one and/or transverse directions to form microvoids around the inorganic particles.

In one embodiment, the permeable microvoided layer is extruded as a monolayer film. Preferably, the permeable microvoided layer is stretched at a temperature of under 90° C., preferably at a temperature of 74 to 84° C., more preferably about 78° C.

If crosslinked organic microbead spheres are used as void initiators, they may range in size from 0.2 to 5.0 μm. Crosslinked organic microbeads preferably comprise a polystyrene, polyacrylate, polyallylic, or poly(methacrylate) polymer. See also commonly assigned copending U.S. Ser. No. 10/374,639 filed Feb. 26, 2003 by Dennis E. Smith et al.

and U.S. Ser. No. 10/033,457 filed Dec. 27, 2001 by Dennis E. Smith et al., hereby incorporated by reference in their entirety.

In the case of non-crosslinked polymer particles in the voided layer, such particles should be immiscible with the polylactic-acid-based material. Typical non-crosslinked polymer particles that are immiscible with the polylactic-acid-based material particles are olefins. The preferred olefin non-crosslinked polymer particles which may be blended with the polylactic-acid based material are homopolymers or copolymers of polypropylene or polyethylene. Polypropylene is preferred.

Preferred polyolefin non-crosslinked polymer particles are immiscible with the polylactic-acid-based material of the film and exists in the form of discrete non-crosslinked polymer particles dispersed throughout the oriented and heat set film. Voiding occurs between the non-crosslinked polymer particles and the polylactic-acid matrix, when the film is stretched. Suitably, the non-crosslinked polymer particles should be blended with the polylactic-acid-based material prior to extrusion through the film forming die by a process which results in a loosely blended mixture and does not develop an intimate bond between the polylactic-acid-based material and the preferred polyolefin non-crosslinked polymer particles.

Such a blending operation preserves the incompatibility of the components and leads to voiding when the film is stretched. A process of dry blending the polylactic-acid-based material and preferred polyolefin non-crosslinked polymer particles has been found to be useful. For instance, blending may be accomplished by mixing finely divided, for example powdered or granular polylactic-acid-based material and non-crosslinked polymer particles, and thoroughly mixing them together, for example, by tumbling them.

In one embodiment of a microvoided layer for the label element, in which the microvoided layer comprises both crosslinked microbeads or inorganic particles in combination with non-crosslinked particles, the particles are first dispersed into a polylactic-acid-based material prior to the film forming process. This may be accomplished by feeding both the polylactic-acid-based material, in either pellet or powder form, and the particles into a twin screw extruder. The polylactic-acid-based material may be melted and the particles may be dispersed into the poly(lactic acid) melt in the twin screw extruder. The resulting extrudate may be then quenched in a water bath and then pelletized into pellets to be used in the film forming process. These pellets may be then dry blended with the preferred polyolefin non-crosslinked polymer particle of choice, typically a polypropylene. The preferred polyolefin non-crosslinked polymer particle may be typically in pellet form as well. Pellets of polylactic-acid-based material may also be added to the dry blend if modifications to the volumetric loading of inorganic particles or organic microbeads and the non-crosslinked polymer particles are desired. The ratio of the volume of particles used relative to the volume of the non-crosslinked polymer particle polymer used in the final blend may range from 4:1 to 1:4, preferably 2:3 to 3:2. In this embodiment, a preferred ratio is about 1:1.

Optionally, the resulting mixture, for making the microvoided layer, may be fed to a film forming extruder along with a material for the one or more other layers to be coextruded, thereby forming a pragmatic polymer film in the form of a composite film (multilayer). The extrusion, quenching and stretching of the composite film may be effected by any process which is known in the art for producing oriented polymeric film, for example by a flat film process or a bubble or tubular process. The flat film process is preferred for making the film and involves extruding the blend through a slit die and rapidly quenching the extruded web upon a chilled casting drum so that the polylactic-acid-based material component of the film may be quenched into the amorphous state. The quenched composite film may be then biaxially oriented by stretching in mutually perpendicular directions at a temperature above the glass-rubber transition temperature of the polylactic-acid-based material. Generally the composite film is stretched in one direction first and then in the second direction although stretching may be effected in both directions simultaneously if desired. In a typical process, the composite film is stretched firstly in the direction of extrusion over a set of rotating rollers or between two pairs of nip rollers and is then stretched in the direction transverse thereto by means of a tenter apparatus. The composite film may be stretched in each direction to 2.5 to 4.5 times its original dimension in the direction of stretching. The ratio of the stretching in each direction is preferably such as to form voids in the sheet with a width to length ratio of from 1:1 to 2:1. After the composite film has been stretched it may be heat set by heating to a temperature sufficient to crystallize the polylactic-acid-based material while restraining the composite film against retraction in both directions of stretching. The voiding tends to collapse as the heat setting temperature is increased above 115° C. and the degree of collapse increases as the temperature increases. Hence the void volume decreases with an increase in heat setting temperatures. While heat setting temperatures up to 135° C. may be used without destroying the voids, temperatures below 115° C. may result in a greater degree of voiding.

The size of the microvoids formed is determined by the size of the void initiators used to initiate the void and by the stretch ratio used to stretch the oriented polymeric film. The pores may range from 0.6 to 150 μm in machine and cross machine directions of the film. They typically range from 0.2 to 30 μm in height. Preferably the height of the pores is in the range of 0.5 to 15.0 μm.

A void volume of from 25% to 55% is preferred for thermal-dye-transfer label elements. The density of the microvoided layer should be less than 0.95 grams/cc. The preferred range is 0.40 to 0.90 grams/cc.

One embodiment of the thermal dye-transfer label receiver elements of the invention comprises, on the top surface, a dye-image receiving layer that comprises, for example, a polycarbonate, a polyurethane, a polyester, polyvinyl chloride, poly(styrene-co-acrylonitrile), poly(caprolactone) or mixtures thereof. The image-receiving layer may be present in any amount which is effective for the intended purpose. In general, good results have been obtained at a concentration of from about 1 to about 5 $g/m^2$. In a preferred embodiment of the invention, the dye image-receiving layer is a polycarbonate, polyester or blend of the two. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, and 2,2-bis(oxyphenyl)butane. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®.

In a preferred embodiment of the invention, the image-receiving layer comprises a polymeric binder containing a polyester and/or polycarbonate. In another embodiment, the image-receiving layer comprises a blend of a polyester and a polycarbonate polymer. Preferably, such blends comprise the polyester and polycarbonate in a weight ratio of polyester to polycarbonate of 10:90 to 90:10, preferably 0.8:1 to 4.0:1. In the preferred embodiment, the polyester comprises polyethylene(terephthalate) or a blend thereof. For example, in one embodiment of the invention, a polyester polymer is blended with an unmodified bisphenol-A polycarbonate and at a weight ratio to produce the desired Tg of the final blend and to minimize cost. Conveniently, the polycarbonate and polyester polymers may be blended at a weight ratio of from about 75:25 to about 25:75. The following polyester polymers E-1 and E-2 comprised of recurring units of the illustrated monomers, are examples of polyester polymers usable in the receiving layer polymer blends of the invention.

E-1: Polymer derived from 1,4-cyclohexanedicarboxylic acid, 4,4'-bis(2-hydroxyethyl)bisphenol-A and 1,4-cyclohexanedimethanol represented by the following structure:

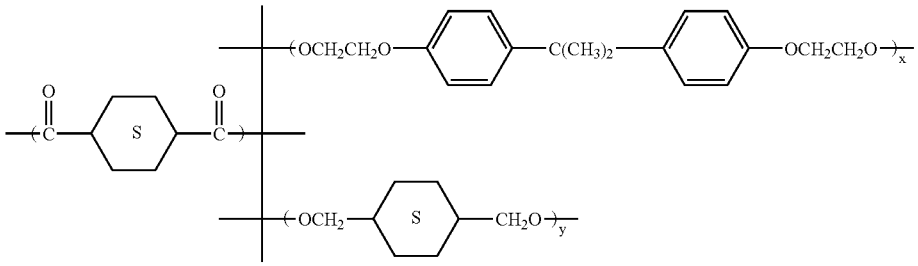

x = 50 mole %m = 50 mole%

(mole % based on total monomer charge of acid and glycol monomers)

E-2: A polymer, useful in making an extruded image-receiving layer, is derived from 1,4-cyclohexanedicarboxylic acid, 1,4-cyclohexanedimethanol, 4,4'-bis(2-hydroxyethyl)bisphenol-A and 2-ethyl-2-(hydroxymethyl)-1,3-propanediol represented by the following structure.

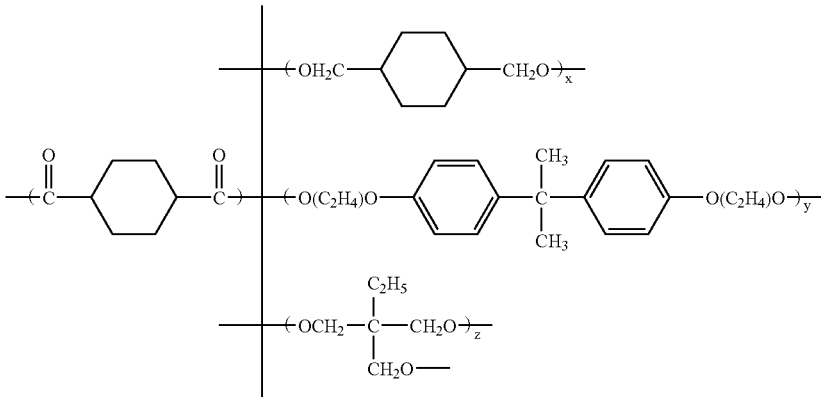

x = 48 mole %
y = 50 mole %
z = 2 mole %

Further examples of polymeric compositions and related processing of image-receiving layers are disclosed in commonly assigned, copending U.S. Ser. No. 10/376,188 filed Feb. 26, 2003 by Teh-Ming Kung et al., hereby incorporated by reference in its entirety.

As conventional, the image-receiving layer can further comprise a release agent. Conventional release agents include but are not limited to silicone or fluorine based compound. Resistance to sticking during thermal printing may be enhanced by the addition of such release agents to the dye-receiving layer or to an overcoat layer. Various releasing agents are disclosed, for example, in U.S. Pat. No. 4,820,687 and U.S. Pat. No. 4,695,286, the disclosures of which are hereby incorporated by reference in their entirety.

A plasticizer may be present in the dye image-receiving layer in any amount which is effective for the intended purpose. In general, good results have been obtained when the plasticizer is present in an amount of from about 5 to about 100%, preferably from about 10 to about 20%, based on the weight of the polymeric binder in the dye image-receiving layer.

In one embodiment of the invention, an aliphatic ester plasticizer is employed in the dye image-receiving layer. Suitable aliphatic ester plasticizers include both monomeric esters and polymeric esters. Examples of aliphatic monomeric esters include ditridecyl phthalate, dicyclohexyl phthalate, and dioctylsebacate. Examples of aliphatic polyesters include polycaprolactone, poly(1,4-butylene adipate), and poly(hexamethylene sebacate). In a preferred embodiment of the invention, the monomeric ester is dioctylsebacate or bis-(1-octyloxy-2,2,6,6-tetramethyl-4-piperidinyl) sebacate, Tinuvin 123® (Ciba Geigy Co.).

It has been found advantageous to include, as an additive to the composition of the dye-receiving layer, a phosphorous-containing stabilizer such as phosphorous acid or an organic diphosphite such as bis(2-ethylhexyl)phosphite, to prevent degradation of the polyester polymer blend during high temperature melt extrusion. The phosphorous stabilizer can be combined, for example, with a plasticizer such as dioctyl sebacate or the like. Preferably, to improve compatibility, the plasticizer is combined with the stabilizer prior to combining both with the other components of the dye-receiving layer. Further details of a preferred dye-receiving element are disclosed in copending, commonly assigned U.S. Ser. No. 10/376,188 filed Feb. 26, 2003, hereby incorporated by reference.

A pressure-sensitive label adhesive is utilized in the invention to allow a thermal-dye-transfer packaging label to be adhered to the surface of the package typically utilizing high speed packaging equipment. "Peelable separation" or "peel strength" or "separation force" is a measure of the amount of force required to separate the thermal-dye-transfer label from the package to which the label has been applied. The peel strength is the amount of force required to separate two surfaces that are held together by internal forces of the label adhesive which consist of valence forces or interlocking action, or both. Peel strength is measured using an Instron gauge wherein the sample is peeled at 180 degrees with a crosshead speed of 1.0 meters/min. The sample width is 5 cm and the distance peeled is 10 cm in length.

A peelable label adhesive can be utilized to allow the consumer to separate the label from the package. Separation of a label from the package would allow for example, rebate coupons to be attached to the package or used for consumer promotions. For a peelable label adhesive, the preferred peel strength between the thermal-dye-transfer pressure sensitive label and the package is no greater than 80 grams/cm. At a peel strength greater than 100 grams/cm, consumers would begin to have difficulty separating the image from the package. Further, at peel strengths greater than 110 grams/cm, the force is beginning to approach the internal strength of paper substrate, causing an unwanted fracture of the paper substrate before the separation of the image from the package. A peelable label can be useful for allowing collection of high quality labels.

Upon separation of the image (label) from the underlying substrate, the peelable label adhesive has a preferred repositioning peel strength between 20 grams/cm and 100 grams/cm. Repositioning peel strength is the amount of force required to peel the separated image containing a label adhesive from a stainless steel block at 23° C. and 50% RH. At repositioning peel strengths less than 15 grams/cm, the label adhesive lacks sufficient peel strength to remain adhered to a variety of surfaces such as refrigerators or photo albums. At peel strengths greater than 120 grams/cm, the label adhesive is too aggressive, not allowing the consumer to later reposition the image.

The peelable label adhesive used in this invention may be a single layer or two or more layers. For a label having two adhesive layers, an upper and lower adhesive layer, for example, a lower adhesive layer preferentially adheres to the substrate to which the label is attached, while an upper adhesive layer preferentially a carrier. (On the other hand, the lower adhesive layer must be more easily separable from the carrier than the upper adhesive layer from its underlying layer.) The separation of the upper adhesive layer from its underlying layer allows the removal of a "successive pragmatic label" (without carrier) capable of repositioning. A "successive pragmatic label" can consist of the face stock or original pragmatic label minus layers under the upper adhesive layer, excluding the lower adhesive layer adhered to the substrate or objective body and the layer or layers between the two adhesive layers. As the "successive pragmatic label" is separated from the substrate, this allows an upper adhesive layer to be adhered to a "successive label base" for repositioning of the successive pragmatic label.

A carrier that comprises a release layer for a label adhesive that repositions is preferred. The release layer allows for uniform separation of the label adhesive at the label adhesive-carrier interface. The release layer may be applied to the liner by any method known in the art for applying a release layer to a substrate. Examples include silicone coatings, tetrafluoroethylene fluorocarbon coatings, fluorinated ethylene-propylene coatings, and calcium stearate.

For single or multiple layer label adhesive systems, the preferred label adhesive composition is selected from the group consisting of natural rubber, synthetic rubber, acrylics, acrylic copolymers, vinyl polymers, vinyl acetate-, urethane, acrylate-type materials, copolymer mixtures of vinyl chloride-vinyl acetate, polyvinylidene, vinyl acetate-acrylic acid copolymers, styrene butadiene, carboxylated styrene butadiene copolymers, ethylene copolymers, polyvinyl alcohol, polyesters and copolymers, cellulosic and modified cellulosic, starch and modified starch compounds, epoxies, polyisocyanate, and polyimides.

Water-based pressure-sensitive adhesion provide some advantages for the manufacturing process of non-solvent emissions. A repositionable peelable label adhesive containing non-adhesive solid particles randomly distributed in the label adhesive layer aids in the ability to stick and then remove the label to get the desired end result. The most preferred pressure-sensitive peelable label adhesive is a respositionable label-adhesive layer containing at about 5% to 20% by weight of a permanent label adhesive such as isooctyl acrylate/acrylic acid copolymer and at about 95% to 80% by weight of a tacky elastomeric material such as acrylate microspheres with the label adhesive layer coverage at about 5 to 20 g/m$^2$.

The preferred peelable-label adhesive materials may be applied using a variety of methods known in the art to produce thin, consistent label adhesive coatings. Examples include gravure coating, rod coating, reverse roll coating, and hopper coating. The label adhesives may be coated on the carrier/liner or a component sheet of the carrier prior to lamination.

In other embodiments, a permanent or non-peelable label-adhesive composition is preferred. For single or multiple-layer label-adhesive systems, this permanent label-adhesive composition is selected from the group consisting of epoxy, phenoformaldehyde, polyvinyl butyral, cyanoacrylates, rubber based label adhesives, styrene/butadiene based label adhesives, acrylics, and vinyl derivatives. Peelable label adhesives and permanent label adhesives may be used in combination in the same layer or in different locations in the support structure.

The thermal-dye-transfer imaging layers on a pressure sensitive substrate preferably are applied to a variety of packages in automated labeling equipment. Preferred package types are bottles, cans, stand up pouches, boxes and bags. The packages may contain materials that require a package for sale. Preferred materials that are packaged include liquids and particulates.

A thermal-dye-transfer packaging label made by the present invention preferably has a thickness of less than 250 μm. A thermal-dye-transfer packaging label assembly greater than 250 μm offers no significant improvement in either imaging quality or packaging label performance. Further, transport through high speed packaging equipment is difficult at a label thickness greater than 250 μm and stripping the labels utilizing the Bernoulli method is difficult if the thickness is too great.

In one embodiment, the initial score cut of the pre-label pragmatic sheet and the adhesive layer is preferably accomplished by multiple double-edged circular razor discs, 6.35 cm diameter, 0.30 mm thick, with 20–30 degree included angles. The discs were used in pairs on a common arbor with a spacing between them of 1.52 mm to 3.10 mm. Several of these pairs were then rigidly mounted onto a common driven arbor, and mounted on an arbor situated directly above a second arbor, which was carefully aligned to the first. Mounted on this second driven arbor was a precision ground, receiver sheet density polymer sleeve, 12.7 cm diameter, which served as a backup to the razor discs. Teflon® polymer sleeves are preferred as Teflon® provides a low coefficient of friction material with excellent run out and compression to accomplish a high quality cut. It has been shown that with both the discs and the sleeve, radial runout needs to be tightly controlled to within 0.003 mm for a high quality cut.

In one embodiment, a pre-label receiver sheet, in the form of a web or continuous roll material was scored by feeding the web material up through the machine and over the top of the lower arbor with sleeve. The top arbor with the razor discs was lowered downward until scratches were noticed on the surface of the material. At this point the discs are just making contact with the material. It was then necessary to lower the discs further, enough to penetrate the face layers and adhesive layer. Care was taken not to penetrate too far into the carrier sheet, which will cause the web material to be completely cut through. As the web material was unwound and fed through the machine, the razor discs cut several distinct zones on the surface of the material. The machine was stopped, and with careful manipulation, the narrow strips were gripped and pulled upwards 45–90 degrees to the material surface. These strips were fed to other rewind spindles for windup, at a suitable tension.

The scoring and stripping process removed narrow strips of pragmatic pre-label sheet and adhesive. The web material is designed in such a way that the adhesive remains attached to the pragmatic pre-label sheet as it is removed and spooled up. The zones where the strips were attached were clear of any pragmatic pre-label sheet or adhesive.

Another preferred slitting technique would be to incorporate a separate scoring and stripping station directly behind the slitter knives. As the web material was scored and stripped, it would pass directly into the slitter knives, which would be precisely aligned to cut the material down the center of the stripped zone. This process would likely be more efficient as problems with web alignment are reduced.

Another slitting technique not shown for producing tack free edges is the use of a cutting die. Utilization of a cutting die to cut the pragmatic pre-label sheet and adhesive allows for a high precision cut of the pragmatic pre-label sheet and adhesive without the need for knives. The cutting die may be a rotary die or a magnetic die attached to rotary cylinder by way of magnets.

Another preferred method of providing a tack free edge is by the use of laser slitting of the pragmatic pre-label sheet. Laser scoring is accomplished by focusing a high power laser beam on to the surface of the pragmatic pre-label sheet to be scored. In this case, the web material is preferably translated under a stationary focused laser beam. The depth of the laser score into the pragmatic pre-label sheet of the invention is critical to the performance of the scoring operation. Insufficient depth of laser score results in incomplete slitting and thus separation of the pragmatic pre-label sheet from the carrier sheet. A laser score than penetrates too far into the carrier sheet results in a loss of bending resistance as the carrier sheet is partially fractured. Depth of laser score is a function of the laser power density per unit area and the translation velocity of the focused spot in relation to the material. The translation of the material or translation of the focused spot can be described as laser energy density per unit area. Laser scoring can be accomplished with either a repetitively pulsed laser or a continuous wave (CW) laser. The pulse rate of the laser should be approximately 1 pulse per second to continuous. The laser optical power should be sufficient to ablate or vaporize the material to be scored when focused with a positive lens. The focal length of the lens preferably is in the range of 3 mm to 500 mm.

The wavelength of the laser should be of a wavelength that is absorptive to the pragmatic pre-label sheet being scored. The preferred wave length for the scoring of the pragmatic pre-label sheet of the invention is between 100 nm to 20,000 nm wavelength. The material should be translated at a velocity in which sufficient laser energy to cause ablation is not exceeded. The translated velocity of the web material of the invention preferably is between 1.0 meters/min to 600 meters/min.

The following is an example of a preferred opaque, reflective thermal-dye-transfer pressure-sensitive label structure that has an environmental protection layer (EPL) applied to the outermost thermal-dye-transfer imaging layer. A bright red tint has been incorporated into the polyethylene layer to provide a bright red background for the thermal-dye-transfer formed image.

| |
|---|
| Image-receiving layer with thermal-dye-transfer formed image |
| Pragmatic Polymer Film |
| Acrylic pressure sensitive adhesive |
| Cellulose paper peelable back |

In one embodiment, the label comprises a dye-receiving layer on both sides of the pragmatic polymer sheet as indicated, for example, below.

| |
|---|
| First Dye Receiving Layer for thermal-dye-transfer formed image |
| Pragmatic Polymer Sheet |
| Second Image-Receiving Layer for thermal-dye-transfer formed image |
| Acrylic pressure sensitive adhesive |
| Cellulose paper peelable back |

The image can further comprise fiducial marks. The fiducial marks printed on the label allow for registration of the label during die cutting of the pragmatic sheet and stripping of the pragmatic sheet. The digital thermal-dye-transfer imaging system disclosed above allows for label images that contain text, graphics, and image content to be printed utilizing digital files.

Distributive printing, or a method of printing where image files are printed at several remote locations, allows for label files to be quickly printed and distributed to product labeling lines. This significant reduction in printing cycle time significantly reduces the cost of thermal-dye-transfer label in that the travel time from the printer to the label line is significantly reduced. Further, the label content can be easily changed as inventory is reduced between label manufacturing and the labeling line.

An example of distributive printing is as follows; label creation performed on a digital work station in one central location after approval is sent to remote printers via the internet. Thermal-dye-transfer labels are printed in several geographic locations and upon completion of the printing, processing, protecting the image, die cutting, and stripping of the matrix, the thermal-dye-transfer printed labels are sent to product labeling lines. Further, several different digital label files can be sent to the remote printers. The files might contain language differences, geographic image preference, and country specific labeling requirements for text.

In another embodiment of the invention, the printing of labels is determined by the consumption of the consumer good being labeled. For example, laser scanning of a thermal-dye-transfer shampoo bottle containing a bar code in the store could detect the number of labels being utilized and by means of an internet connection, feedback to the label printer as to the amount of labels required for the next run of the shampoo labels. Further, by laser scanning the labels, a software program could determine the consumer preference for a label type or image used on the label and that critical information can be fed back through the internet to the remote label printing device to update the label file for a specific consumer preference thereby providing labeling changes based on consumer purchasing patterns.

Dye Donor: A dye-donor element that is used with the thermal dye-receiving label element comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

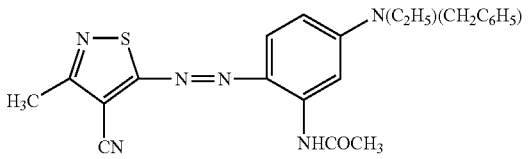

-continued

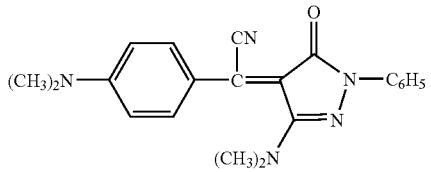

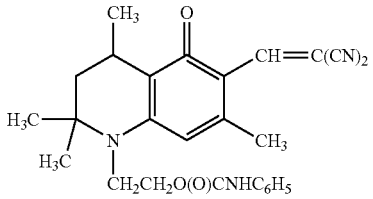

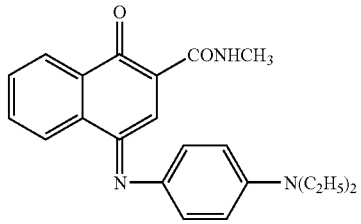

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m2 and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone), or a poly(phenylene oxide). The binder may be used at a coverage of from about 0.1 to about 5 g/m$^2$.

The dye layer of the dye-donor element may be coated on the support or printed thereon by a printing technique such as a gravure process. The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly (vinyl stearate), beeswax, perfluorinated alkyl ester polyethers, poly(caprolactone), carbowax, or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 wt %, preferably 0.5 to 40, of the polymeric binder employed.

As noted above, the dye-donor elements and pre-label receiver sheets are used to form a dye transfer image. Such a process comprises imagewise-heating a dye-donor element as described above and transferring a dye image to a pre-label receiver sheet to form a dye transfer image for a label.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment, the dye-donor element comprises a poly(ethylene terephthalate) support coated with sequential repeating areas of cyan, magenta, and yellow dye, and the above process steps are sequentially performed for each color to obtain a three-color dye transfer image. Of course, when the process is only performed for a single color, then a monochrome dye transfer image is obtained.

In a preferred embodiment of the invention, a dye-donor element may be employed which comprises a poly(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image may be obtained. The dye-donor element may also contain a colorless area which may be transferred to the receiving element to provide a protective overcoat. This protective overcoat may be transferred to the receiving element by heating uniformly at an energy level equivalent to 85% of that used to print maximum image dye density.

A thermal-dye-transfer assemblage comprises: a) a dye-donor element as described above, and b) a pre-label receiver sheet as described above, the pre-label receiver sheet being in a superposed relationship with the dye-donor element so that the dye layer of the donor element is in contact with the dye image-receiving layer of the receiver element. The above assemblage comprising these two elements may be pre-assembled as an integral unit when a monochrome image is to be obtained. This may be done by temporarily adhering the two elements together at their margins. After transfer, the pre-label receiver sheet is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving label element and the process repeated. The third color is obtained in the same manner.

Thermal printing heads which can be used to transfer dye from dye-donor elements to the label elements of the invention are available commercially. There can be employed, for example, a Fujitsu Thermal Head (FTP040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

EXAMPLES

Preparation of Resin for Image-receiving Layer:

For the examples below the resin pellets used to extrude the dye receiving layer were formulated by introducing the following components into a Leistritz 27 mm Twin Screw Compounding Extruder heated to 210° C.:

1) Polyester: 157.45 kg (914.46 moles) of cis and trans isomers of cyclohexanedicarboxylic acid, 144.66 kg (457.23 moles) of bisphenol A diethanol, 2.45 kg (18.29 moles) of trimethylolpropane, 66.47 kg (460.89 moles) of cis and trans isomers of cyclohexanedimethanol, and 82.51 g of butylstannoic acid catalyst were added to a 150 gallon polyester reactor equipped with a low speed helical agitator. The batch was heated to a final temperature of 275° C. The water byproduct of the esterification reaction began to distill over at 171° C. after about two hours of heat-up. Two hours later at an internal temperature of 267° C., the reactor pressure was ramped down at 10 mm Hg per minute to 3 mm Hg absolute pressure. After two hours under vacuum, the pressure was reduced to 1 mm Hg. After 3 hours and 30 minutes total, the vacuum was relieved with nitrogen and the very viscous polyester was drained from the reactor onto trays which cooled overnight. The solidified polyester was ground through a ¼" screen. The inherent viscosity in methylene chloride at 0.25% solids was 0.58, the absolute Mw was 102,000, the Mw/Mn was 6.3 and the glass transition temperature by DSC on the second heat was 55.8° C.

2) Polycarbonate (Lexan® 141 from GE Polymers) at 29.2% wt.

3) Polyester elastomer with Silicone (MB50-10 from Dow Corning) at 4% wt.

4) Dioctyl Sebacate (from Acros Organics) at 2.6% wt.

5) Poly(1,3-butylene glycol adipate) (Admex®429) at 2.6% wt.

6) Stabilizer(Weston® 619) at 0.2%

The melted mixture was extruded as a strand into a water bath and then pelletized.

Comparative Example 1

This example illustrates the preparation of a comparative pre-label pragmatic sheet comprising voided polyester. A Leistritz® 27 mm Twin Screw Compounding Extruder heated to 275° C. was used to mix 1.7 μm beads made from 70 wt % methylmethacrylate crosslinked with 30 wt % divinylbenzene (Tg=160° C.), and a 1:1 blend of poly (ethylene terephthalate), referred to as "PET", commercially available as #7352 from Eastman Chemicals, and PETG 6763 polyester copolymer poly(1,4-cyclohexylene dimethylene terephthalate) from Eastman Chemicals. All components were metered into the compounder and one pass was sufficient for dispersion of the beads into the polyester matrix. The microbeads were added to attain a 30% by weight loading in the polyester. The compounded material was extruded through a strand die, cooled in a water bath, and pelletized. The pellets were then dried in a desiccant dryer at 65° C. for 12 hours.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of polyester and microbeads, layer 2, and a ¾ inch extruder to extrude the compounded pellets of dye receiving layer, layer 1. Layer 2 was extruded at 275° C. while layer 1 was extruded at 250° C. The melt streams were fed into a 7 inch multi-manifold die heated at 275° C. As the extruded sheet emerged from the die, it was cast onto a quenching roll set at 55° C. The final dimensions of the continuous cast sheet were 18 cm wide and 680 μm thick. Layer 2 was 640 μm thick while layer 1 was 40 μm thick. The cast sheet was then stretched simultaneously at 110° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® F132311, a transfer film manufactured by FLEXcon Corp., and laminating the exposed adhesive along with the backing film (liner) to the composite film described above. The resulting label media can be printed, dye cut, and applied to a product by first removing the liner and applying the exposed adhesive to said product.

Comparative Example 2

This example illustrates an attempted preparation of another comparative pre-label pragmatic sheet comprising voided polyester, using an inorganic void initiator. A Leistritz® 27 mm Twin Screw Compounding Extruder heated to 275° C. was used to mix 0.3 μm Zinc Sulfide particles (Sachtolith® HD-S by Sachtleben) and a 1:1 blend of poly(ethylene terephthalate), "PET", commercially available as #7352 from Eastman Chemicals, and PETG 6763 polyester copolymer, poly(1,4-cyclohexylene dimethylene terephthalate) from Eastman Chemicals. All components were metered into the compounder and one pass was sufficient for dispersion of the beads into the polyester matrix. The Zinc Sulfide particles were added to attain a 55% by weight loading in the polyester. The compounded material was extruded through a strand die, cooled in a water bath, and pelletized. The compounded pellets were dried in a desiccant dryer at 65° C. for 12 hours.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of polyester and Zinc Sulfide, layer 2, and a ¾ inch extruder to extrude the compounded pellets of dye receiving layer, layer 1. Layer 2 was extruded at 275° C. while layer 1 was extruded at 250° C. The melt streams were fed into a 7-inch multi-manifold die also heated at 275° C. As the extruded sheet emerged from the die, it was cast onto a quenching roll set at 55° C. The final dimensions of the continuous cast sheet were 18 cm wide and 680 μm thick. Layer 2 was 640 μm thick while layer 2 was 130 μm thick. An attempt was then made to stretch the cast sheet simultaneously at 110° C. 3.3 times in the X-direction and 3.3 times in the Y-direction. The sheet continued to tear upon such attempts and the film was deemed non-manufacturable.

Comparative Example 3

This example illustrates an attempted preparation of another comparative pre-label pragmatic sheet comprising voided polyester, using a different inorganic void initiator. A Leistritz® 27 mm Twin Screw Compounding Extruder heated to 275° C. was used to mix 0.8 μm Barium Sulfate particles (Blanc Fixe® XR-HN by Sachteleben) and a 1:1 blend of poly(ethylene terephthalate), "PET," commercially available as #7352 from Eastman Chemicals, and PETG 6763 polyester copolymer, poly(1,4-cyclohexylene dimethylene terephthalate) from Eastman Chemicals. All components were metered into the compounder and one pass was sufficient for dispersion of the beads into the polyester matrix. The Barium Sulfate particles were added to attain a 58% by weight loading in the polyester. The compounded material was extruded through a strand die, cooled in a water bath, and pelletized. The compounded pellets were dried in a desiccant dryer at 65° C. for 12 hours.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of polyester and Barium Sulfate, layer 2, and a ¾ inch extruder to extrude the compounded pellets of dye receiving layer, layer 1. Layer 2 was extruded at 275° C. while layer 1 was extruded at 250° C. The melt streams were fed into a 7 inch multi-manifold die also heated at 275° C. As the extruded sheet emerged from the die, it was cast onto a quenching roll set at 55° C. The final dimensions of the continuous cast sheet were 18 cm wide and 680 μm thick. Layer 2 was 640 μm thick while layer 2 was 130 μm thick. An attempt was then made to stretch the cast sheet simultaneously at 110° C., 3.3 times in the X-direction and 3.3 times in the Y-direction. The sheet continued to tear upon such attempts and the film was deemed non-manufacturable.

Example 1

This example illustrates the preparation of one embodiment of a pre-label pragmatic sheet of the present invention. A Leistritz® 27 mm Twin Screw Compounding Extruder heated to 200° C. was used to mix 1.7 μm beads made from 70 wt % methylmethacrylate crosslinked with 30 wt % divinylbenzene (Tg=160° C.) and polylactic acid, "PLA," NatureWorks® 2002-D from Cargill-Dow. The components were metered into the compounder and one pass was sufficient for dispersion of the beads into the PLA matrix. The microbeads were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and microbeads, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 2

This example illustrates the preparation of another embodiment of a pre-label pragmatic sheet of the present invention. A Leistritz® 27 mm Twin Screw Compounding Extruder heated to 200° C. was used to mix 0.3 μm Zinc Sulfide particles (Sachtolith® HD-S by Sachtleben) and polylactic acid, "PLA," NatureWorks® 2002-D from Cargill-Dow. The components were metered into the compounder and one pass was sufficient for dispersion of the particles into the PLA matrix. The Zinc Sulfide particles were added to attain a 55% by weight loading in the PLA. The compounded material was extruded through a strand die, cooled in a water bath, and pelletized. The compounded pellets were then dried in a desiccant dryer at 50° C.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of PLA and Zinc Sulfide, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 3

This example illustrates the preparation of another embodiment of a pre-label pragmatic sheet of the present invention. A Leistritz® 27 mm Twin Screw Compounding Extruder heated to 200° C. was used to mix 0.8 μm Barium Sulfate particles (Blanc Fixe® XR-HN by Sachteleben) and polylactic acid or PLA, NatureWorks® 2002-D from Cargill-Dow. The components were metered into the compounder and one pass was sufficient for dispersion of the particles into the PLA matrix. The Barium Sulfate particles were added to attain a 58% by weight loading in the PLA. The compounded material was extruded through a strand die, cooled in a water bath, and pelletized. The compounded pellets were then dried in a desiccant dryer at 50° C.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of PLA and Barium Sulfate, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 4

This example illustrates the preparation of another embodiment of a pre-label pragmatic sheet of the present invention. A Leistritz 27 mm Twin Screw Compounding Extruder heated to 200° C. was used to mix 0.3 μm Zinc Sulfide particles (Sachtolith® HD-S by Sachtleben) and polylactic acid or PLA, NatureWorks 2002-D by Cargill-Dow. The components were metered into the compounder and one pass was sufficient for dispersion of the particles into the PLA matrix. The Zinc Sulfide particles were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of PLA and Zinc Sulfide, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 5

This example illustrates the preparation of another embodiment of a pre-label pragmatic sheet of the present invention. A Leistritz® 27 mm Twin Screw Compounding Extruder heated to 200° C. was used to mix 0.8 μm Barium Sulfate particles (Blanc Fixe® XR-HN by Sachteleben) and polylactic acid or PLA, NatureWorks® 2002-D by Cargill-Dow. The components were metered into the compounder and one pass was sufficient for dispersion of the particles into the PLA matrix. The Barium Sulfate particles were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of PLA and Barium Sulfate, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 6

This example illustrates the preparation of another embodiment of a pre-label pragmatic sheet of the present invention. A Leistritz® 27 mm Twin Screw Compounding Extruder heated to 200° C. was used to mix 0.2 μm Titanium Dioxide particles (R-104 from Dupont) and polylactic acid or PLA, NatureWorks® 2002-D by Cargill-Dow. The components were metered into the compounder and one pass was sufficient for dispersion of the particles into the PLA matrix. The Titanium Dioxide particles were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded dye receiving layer were dried in a desiccant dryer at 50° C. for 12 hours.

Cast sheets were co-extruded to produce a two layer structure using a 1¼ inch extruder to extrude the compounded pellets of PLA and Titanium Dioxide, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 7

This example illustrates the preparation of another embodiment of a pre-label pragmatic sheet of the present invention. Polylactic acid or PLA, NatureWorks® 2002-D by Cargill-Dow) was dry blended with Polypropylene ("PP" from Huntsman P4G2Z-073AX). The PP was added at 25% by weight to the PLA. The blended pellets were then dried in a desiccant dryer at 50° C.

Then the polyester-compounded resin pellets formulated as described above for the extruded dye receiving layer were dried in a desiccant dryer at 50° C. for 12 hours.

Cast sheets were co-extruded to produce a two layer structure using a 1¼ inch extruder to extrude the blended pellets of PLA and PP, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 8

This example illustrates the preparation of another embodiment of a pre-label pragmatic sheet of the present invention. A Leistritz® 27 mm Twin Screw Compounding Extruder heated to 200° C. was used to mix 0.3 μm Zinc Sulfide particles (Sachtolith® HD-S by Sachtleben) and polylactic acid or "PLA," NatureWorks 2002-D by Cargill-Dow. The components were metered into the compounder and one pass was sufficient for dispersion of the particles into the PLA matrix. The Zinc Sulfide particles were added to attain a 30% by weight loading in the PLA. The compounded material was extruded through a strand die, cooled in a water bath, and pelletized. The PLA-compounded pellets were then dried in a desiccant dryer at 50° C.

Polylactic acid ("PLA"), NatureWorks® 2002-D by Cargill-Dow, was dry blended with Polypropylene ("PP"), Huntsman P4G2Z-073AX. The PP was added at 26% by weight to the PLA. The blended pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude a 50/50 blend of the blended pellets of PLA and PP and the compounded pellets of PLA and Zinc Sulfide, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure-sensitive adhesive and liner to the film. This can be done by peeling one of the outside layers of FLEXmount Select® DF132311, transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 9

This example illustrates the preparation of another embodiment of a pre-label pragmatic sheet of the present invention. A Leistritz® 27 mm Twin Screw Compounding Extruder heated to 200° C. was used to mix 0.8 μm Barium Sulfate particles (Blanc Fixe® XR-HN by Sachteleben) and polylactic acid or "PLA," NatureWorks 2002-D by Cargill-Dow. The components were metered into the compounder and one pass was sufficient for dispersion of the particles into the PLA matrix. The Barium Sulfate particles were added to attain a 30% by weight loading in the PLA. The compounded material was extruded through a strand die, cooled in a water bath, and pelletized. The compounded pellets were then dried in a desiccant dryer at 50° C.

Polylactic acid (NatureWorks® 2002-D by Cargill-Dow) was dry blended with Polypropylene ("PP"), Huntsman P4G2Z-073AX. The PP was added at 26% by weight to the PLA. The blended pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude a 50/50 blend of the blended pellets of PLA and PP and the compounded pellets of PLA and Barium Sulfate, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Example 10

This example illustrates the preparation of another embodiment of a pre-label pragmatic sheet of the present invention. A Leistritz® 27 mm Twin Screw Compounding Extruder heated to 200° C. was used to mix 0.2 μm Titanium Dioxide particles (R-104 from Dupont) and polylactic acid, NatureWorks® 2002-D by Cargill-Dow ("PLA"). The components were metered into the compounder and one pass was sufficient for dispersion of the particles into the PLA matrix. The Titanium Dioxide particles were added to attain a 30% by weight loading in the PLA. The compounded material was extruded through a strand die, cooled in a water bath, and pelletized. The compounded pellets were then dried in a desiccant dryer at 50° C.

Polylactic acid (NatureWorks® 2002-D by Cargill-Dow) was dry blended with Polypropylene ("PP"), Huntsman P4G2Z-073AX). The PP was added at 26% by weight to the PLA. The blended pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude a 50/50 blend of the blended pellets of PLA and PP and the compounded pellets of PLA and Titanium Dioxide, layer 2, and a ¾ inch extruder to extrude the compounded pellets of dye receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be converted to a pre-label receiver sheet by laminating a pressure sensitive adhesive and liner to the film. This can be done by peeling one of the outside layers of FLEXmount Select® DF132311, a transfer film manufactured by FLEXcon, and laminating the exposed adhesive along with the backing film (liner) to the composite film described above. The resulting label media can be printed, dye cut, and applied to a product by first removing the liner and applying the exposed adhesive to said product.

Preparation of Dye-Donor Elements:

The dye-donor used in the example is Kodak Ektatherm ExtraLife® donor ribbon made as follows:

A 4-patch protective layer dye-donor element was prepared by coating on a 6 μm poly(ethylene terephthalate) support:

1) a subbing layer of DuPont Tyzor® TBT titanium alkoxide (0.12 g/m$^2$) from a n-propyl acetate and n-butyl alcohol solvent mixture; and 2) a slipping layer containing an aminopropyldimethyl-terminated polydimethylsiloxane, PS513® (United Chemical Technologies, Inc.)(0.01 g/m$^2$), a poly(vinyl acetal) binder, KS-1 (Sekisui Co.) (0.38 g/m$^2$), p-toluenesulfonic acid (0.0003 g/m$^2$), polymethylsilsesquioxane beads 0.5 μm (0.06 g/m$^2$) and candellila wax (0.02 g/m$^2$) coated from a solvent mixture of diethyl ketone and methanol.

On the opposite side of the support was coated:

1) a patch-coated subbing layer of DuPont Tyzor® titanium alkoxide (0.13 g/m$^2$) from a n-propyl acetate and n-butyl alcohol solvent mixture; and 2) repeating yellow, magenta and cyan dye patches containing the compositions as noted below over the subbing layer and a protective patch on the unsubbed portion as identified below.

The yellow composition contained 0.07 g/m$^2$ of a first yellow dye, 0.09 g/m$^2$ of a second yellow dye, 0.25 g/m$^2$ of CAP48220 (20 s viscosity) cellulose acetate propionate, 0.05 g/m$^2$ of Paraplex G-25® plasticizer, and 0.004 g/m$^2$ divinylbenzene beads (2 μm beads) in a solvent mixture of toluene, methanol, and cyclopentanone (66.5/28.5/5).

The magenta composition contained 0.07 g/m$^2$ of a first magenta dye, 0.14 g/m$^2$ of a second magenta dye, 0.06 g/m$^2$ of a third magenta dye, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 μm beads) in a solvent mixture of toluene, methanol, and cyclopentanone (66.5/28.5/5).

The cyan composition contained 0.10 g/m$^2$ of a first cyan dye, 0.09 g/m$^2$ of a second cyan dye, 0.22 g/m$^2$ of a third cyan dye, 0.23 g/m$^2$ of CAP482-20 (20 s viscosity) cellulose acetate propionate, 0.02 g/m$^2$ of Paraplex G-25® plasticizer, 0.04 g/m$^2$ of monomeric glass illustrated below, and 0.009 g/m$^2$ divinylbenzene beads (2 μm beads) in a solvent mixture of toluene, methanol, and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 g/m$^2$) and 0.09 g/m$^2$ of divinylbenzene beads (4 μm beads) which was coated from a solvent mixture of diethylketone and isopropyl alcohol (80:20).

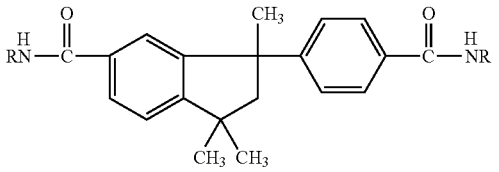

Monomeric Glass
wherein R is

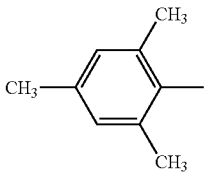

Printing and Evaluation

Table 1 shows a brief description of each example as well as surface roughness of the backside (each layer 2 surface) and the estimated void volume of layer 2 in each example. Surface roughness (Ra) was determined using an optical 3-D roughness gauge and void volume was estimated by void volume fraction defined as the ratio of voided thickness minus unvoided thickness to the voided thickness. Photomicroscopy of a cross-section can be used to determine the actual thickness. The unvoided thickness is defined as the thickness that would be expected had no voiding occurred, for example, the cast thickness divided by the stretch ratio in the machine direction and the stretch ratio in the cross direction.

Table 1 also shows the dye-transfer printing efficiency/quality of the thermal dye-transfer pre-label receiver sheet according to the present invention. An 11-step sensitometric full color image was prepared from the above dye-donor and dye-receiver (pre-label receiver sheet) of Examples 1 thru 10, as well as comparative 1 (comparative examples 2 and 3 were not manufacturable), by printing the donor-receiver assemblage in a Kodak® 8650 Thermal Printer. The dye-donor element was first placed in contact with the polymeric image-receiving layer(IRL) side of the pre-label receiver sheet. The assemblage was positioned on a 18 mm platen roller and a TDK LV5406A thermal head with a head load of 6.35 kg pressed against the platen roller. The TDK LV5406A thermal print head has 2560 independently addressable heaters with a resolution of 300 dots/inch and an average resistance of 3314 Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied at 13.6 volts resulted in an instantaneous peak power of approximately 58.18×10-3 Watt/dot and the maximum total energy required to print Dmax was 0.216 mJoules/dot. This printing process did not heat the protective laminate patch as the protective laminate was not desired in order to measure dye density and non-laminated gloss.

After printing, Status A reflection densities of the 11-stepped image were measured with an X-Rite® Model 820 densitometer (X-Rite Corp., Grandville, Mich.). The optical densities, $OD_{max}$ and $OD_{low}$, of yellow, magenta, and cyan colors (Status A reflection densities at step 1 and step 7, respectively) are shown in Table 1.

Table 1 further shows the 20 degree and 60 degree Gardner gloss measurements of each sample.

TABLE 1

| Sample | Description | Particulate Void Initiator Size (μm) | Surface Roughness (Ra) (micro-inches) | % Void Volume | IRL OD max Y/M/C | IRL OD low Y/M/C | IRL 20 Degree Gloss (no laminate) | IRL 60 Degree Gloss (No laminate) |
|---|---|---|---|---|---|---|---|---|
| Example 1 | 30% wt X-linked beads/PLA | 1.7 | 15 | 64 | 1.90, 1.86, 2.04 | 0.31, 0.27, 0.29 | 5 | 30 |
| Example 2 | 55% ZnS/PLA | 0.3 | 11 | 51 | 1.93, 1.79, 1.92 | 0.35, 0.28, 0.27 | 40 | 78 |
| Example 3 | 58% $BaSO_4$/PLA | 0.8 | 11 | 67 | 1.91, 1.84, 1.98 | 0.32, 0.27, 0.27 | 44 | 80 |
| Example 4 | 30% ZnS/PLA | 0.3 | 12 | 36 | 1.76, 1.51, 1.71 | 0.36, 0.30, 0.29 | 25 | 68 |
| Example 5 | 30% $BaSO_4$/PLA | 0.8 | 13 | 35 | 1.77, 1.57, 1.75 | 0.26, 0.23, 0.23 | 20 | 68 |
| Example 6 | 30% TiO2/PLA | 0.2 | 9 | 48 | 1.73, 1.53, 1.74 | 0.28, 0.22, 0.22 | 37 | 76 |
| Example 7 | 25% PP/PLA | >10 | 39 | 42 | 1.83, 1.66, 1.88 | 0.22, 0.17, 0.19 | 8 | 38 |

TABLE 1-continued

| Sample | Description | Particulate Void Initiator Size (μm) | Surface Roughness (Ra) (micro-inches) | % Void Volume | IRL OD max Y/M/C | IRL OD low Y/M/C | IRL 20 Degree Gloss (no laminate) | IRL 60 Degree Gloss (No laminate) |
|---|---|---|---|---|---|---|---|---|
| Example 8 | 15% ZnS + 13% PP/PLA | 0.3 | 24 | 36 | 1.91, 1.73, 1.94 | 0.33, 0.26, 0.29 | 5 | 26 |
| Example 9 | 15% $BaSO_4$ + 13% PP/PLA | 0.8 | 18 | 41 | 1.87, 1.72, 1.89 | 0.31, 0.30, 0.26 | 13 | 58 |
| Example 10 | 15% $TiO_2$ + 13% PP/PLA | 0.2 | 13 | 36 | 1.88, 1.75, 1.94 | 0.34, 0.37, 0.30 | 15 | 53 |
| Comparative 1 | 30% wt X-linked beads/PET&PETG | 1.7 | 31 | 22 | 1.60, 1.42, 1.68 | 0.12, 0.12, 0.12 | 8 | 40 |
| Comparative 2 | 55% ZnS/PETG&PET | 0.3 | NA | NA | NA | NA | NA | NA |
| Comparative 3 | 58% $BaSO_4$/PETG&PET | 0.2 | NA | NA | NA | NA | NA | NA |

The data in Table 1 indicates that the voided PLA support under an image-receiving layer offers significant improvement in printed dye density, compared to the polyester. It also shows that if smaller particles (less than 1.7 μm) are used to void the PLA support that surface gloss can be attained at high levels (60 degree Gardner gloss greater than 45). The use of such small particles is not robust and cannot be manufactured when using polyester as the voided matrix polymer. The use of immiscible polymers, such as polypropylene (Example 7) can attain high printing density. The use of small particles in combination with immiscible polymer can help increase the lower gloss levels that tend to result in immiscible polymer blends (Examples 9–10).

The invention has been described in detail with particular reference to certain preferred embodiments thereof, but it will be understood that variations and modifications can be effected within the spirit and scope of the invention.

The invention claimed is:

1. A pre-label receiver sheet comprising in order (a) a pragmatic pre-label sheet comprising:

(i) a polymeric image-receiving layer;

(ii) a pragmatic polymer film, either a multi-layer or single layer film, comprising a microvoided layer, in a continuous phase, a polylactic-acid-based material, the microvoided layer having a void volume of at least 25 percent by volume, (b) a pressure-sensitive adhesive layer; and (c) a carrier sheet such that the pressure-sensitive adhesive layer is releasably covered with the carrier sheet in peelable adhesion.

2. The sheet of claim 1 wherein the microvoided layer further comprises void initiating particles used to form microvoids in the microvoided layer.

3. The sheet of claim 1 wherein the pragmatic polymer film is extruded as a single layer.

4. The sheet of claim 2 wherein the particles having a particle size of less than 5 μm.

5. The sheet of claim 1 wherein said microvoided layer is biaxially oriented.

6. The sheet of claim 1 wherein said pragmatic pre-label sheet has a thickness of from about 25 to about 400 μm.

7. The sheet of claim 1 wherein said polylactic-acid-based material is composed of at least 75% by weight of poly(L-lactic acid).

8. The sheet of claim 2 wherein the particles are inorganic and make up from about 25 to about 75 weight % of the total weight of the microvoided layer.

9. The sheet of claim 2 wherein the particles are organic and comprise from about 10 to about 45 weight % of the total weight of the microvoided layer.

10. The sheet of claim 1 wherein said polylactic-acid-based material is a mixture of at least 90% poly(L-lactic acid) and at least 1% poly(D-lactic acid).

11. The sheet of claim 8 wherein the inorganic particles are present in an amount between 35 to 65 weight %.

12. The sheet of claim 8 wherein the inorganic particles are selected from the group consisting of barium sulfate, calcium carbonate, zinc sulfide, zinc oxide, titanium dioxide, silica, alumina, and combinations thereof.

13. The sheet of claim 12 wherein the inorganic particles have an average size from 0.3 to 2.0 μm.

14. The sheet of claim 1 wherein the pragmatic polymer film is multi-layer composite film.

15. The sheet of claim 14 wherein the pragmatic polymer film comprises a second layer comprising a voided or non-voided polylactic-acid-based material and is adjacent to and integral with the microvoided layer.

16. The sheet of claim 15 wherein the pragmatic polymer film comprises a third layer that is microvoided with the second layer between the microvoided first and third layers.

17. The sheet of claim 16 wherein the microvoided first and third layers consist of the same material and the second layer is non-voided.

18. The sheet of claim 1 wherein the polylactic-acid-based material comprises additional polymers or blends of other polyesters.

19. The sheet of claim 1 wherein the carrier sheet is laminated to the pragmatic pre-label sheet so that a front surface of the carrier sheet faces a back surface of the pragmatic pre-label sheet.

20. The sheet of claim 1 wherein at least one pragmatic-label portion is formed in the pragmatic pre-label sheet by cutting a shape through the pragmatic pre-label sheet but not through the carrier sheet.

21. The sheet of claim 1 wherein the image-receiving layer comprises a polyester material.

22. The sheet of claim 1 wherein the pragmatic polymer film further comprises a coextruded second layer in addition to the microvoided layer, the microvoided layer having a top side and a bottom side, wherein the coextruded second layer is on the bottom side of the microvoided layer and the image-receiving layer is on the top side of the microvoided layer.

23. The sheet of claim 1 wherein the pragmatic pre-label sheet consists essentially of only coextruded biaxially stretched layers above the pressure-sensitive adhesive layer.

24. The sheet of claim 1 wherein the pragmatic pre-label sheet consists essentially of an image-receiving layer and the pragmatic polymer film.

25. The sheet of claim 1 wherein the carrier sheet comprises more than one layer.

26. The sheet of claim 1 further comprises at least one image in the image-receiving layer formed by imagewise thermal dye transfer.

27. The sheet of claim 1 wherein cutting lines are formed at least partially through the pragmatic pre-label sheet to form a label sheet, so to allow peeling of at least one pragmatic label portion comprising a portioned (a) imaged image-receiving layer, (b) substrate, and (c) bottom pressure-sensitive adhesive layer, wherein the substrate consists of all the layers, including a portioned (i) pragmatic polymer film and (ii) optional intermediate sheet, between the image-receiving layer and the bottom pressure-sensitive adhesive layer.

28. The sheet of claim 27 wherein the label sheet comprises a plurality of pragmatic-label portions and cutting lines are formed around and through each pragmatic-label portion but substantially not in or through the carrier sheet.

29. The sheet of claim 28 wherein multiple pragmatic-label portions in the label sheet are formed by sectioning the label sheet into a plurality of frames each forming a separable pragmatic label.

30. The sheet of claim 26 wherein the at least one image has a print density of at least 1.5.

31. The sheet of claim 1 wherein the microvoided layer comprises, in a continuous phase, polylactic-acid-based material having dispersed therein void initiators selected from the group consisting of crosslinked organic microbeads, inorganic particles, non-crosslinked polymer particles that are immiscible with the polylactic-acid-based material, and combinations thereof.

32. The sheet of claim 1 wherein the microvoided layer comprises, in a continuous phase, polylactic-acid-based material having dispersed therein a blend of inorganic and non-crosslinked polymer particles that are immiscible with the polylactic-acid-based material.

33. The sheet of claim 32 wherein the ratio of the volume of inorganic to the volume of the non-crosslinked polymer particles that are immiscible with the polylactic-acid-based material is from 4:1 to 1:4.

34. The sheet of claim 1 wherein the pragmatic polymer film comprises a core layer comprised of a non-voided polylactic-acid-based material or a polylactic-acid-based material voided with non-crosslinked polymer particles.

35. The sheet of claim 31 wherein the non-crosslinked polymer particles that are immiscible with the polylactic-acid-based material have an olefinic backbone.

36. The sheet of claim 1 wherein the microvoided layer has a thickness from 20 to 150 micrometers.

37. The sheet of claim 1 wherein the image-receiving layer comprises a polymeric binder containing a polyester and/or polycarbonate.

38. The sheet of claim 1 wherein the pragmatic pre-label sheet is imaged with a thermal-dye-transfer process including imaging with fiducial marks having a density of greater than 0.5.

39. The sheet of claim 1 wherein the carrier sheet comprises exposed edges having a width of less than 20 mm.

40. The sheet of claim 1 wherein the carrier sheet has a stiffness of between 15 and 60 milliNewtons.

41. A thermal-dye-transfer assemblage comprising a dye-donor element, and the pre-label sheet of claim 1.

42. A process for making a pre-label sheet comprising a pragmatic pre-label sheet and a carrier sheet, which pragmatic pre-label sheet comprises, in order, a polymeric image-receiving layer, a pragmatic polymer film, and a bottom pressure-sensitive adhesive layer, which process comprises the following steps:

(a) providing a pragmatic pre-label sheet by the following steps:

(i) blending void-initiating particles into a first melt comprising a polylactic-acid-based material, (ii) coextruding or extruding the first melt to form a cast single-layer or multi-layer film comprising at least one layer made from the first melt;

(iii) stretching the cast film biaxially to reduce its thickness and to form microvoids around the particles, thereby obtaining an oriented stretched film;

(iv) applying an intermediate sheet, comprising one or more layers, to a back surface of the oriented stretched film;

(v) applying a pressure-sensitive adhesive layer, or a laminate comprising a pressure-sensitive adhesive layer, to at least a portion of the back surface of the oriented stretched film, on a side opposite the image-receiving layer, to form a pre-label receiver sheet or, when an intermediate sheet is present, to at least a portion of the back surface of the intermediate sheet; and (vi) applying an image-receiving layer to the pragmatic polymer film either by coextruding the image-receiving layer with the pragmatic polymer film or by solvent coating the image-receiving layer on the pragmatic polymer film; and (b) providing the pre-label sheet with a carrier sheet such that the adhesive layer of the pre-label sheet is releasably covered with the carrier sheet in peelable adhesion.

43. A process for making a pre-label receiver sheet comprising a pragmatic pre-label sheet and a carrier sheet, which pragmatic pre-label sheet comprises, in order, a polymeric image-receiving layer, a pragmatic polymer film, and an adhesive layer, which process comprises the following steps:

(a) providing a pragmatic pre-label sheet by the following steps:

(i) blending void-initiating particles into a first melt comprising a polylactic-acid-based material, (ii) co-extruding a second melt for a polymeric image-receiving layer with one or more other melts for forming a single-layer or multiple-layer pragmatic polymer film, wherein the one or more other melts includes the first melt for forming a microvoidable layer, thereby forming a co-extruded cast composite film comprising at least the image-receiving layer and the microvoidable layer;

(iii) stretching in at least one direction the cast composite film to reduce the thickness of the composite film and to produce an oriented stretched composite film, wherein the image-receiving layer is less than 15 micrometers thick;

(iv) optionally applying an intermediate sheet, comprising one or more layers, to a back surface of the oriented stretched composite film; and (v) applying a pressure-sensitive adhesive layer, or a laminate comprising a pressure-sensitive adhesive layer, to at least a portion of the back surface side of the oriented stretched composite film, on a side opposite the image-receiving layer, or when an intermediate sheet is present, to at least a portion of the back surface of the intermediate sheet; and (b) providing the pre-label sheet with a carrier sheet such that the adhesive layer of the pre-label sheet is releasably covered with the carrier sheet in peelable adhesion.

44. The process of claim 42 wherein the carrier sheet is laminated to the pragmatic pre-label sheet so that a front surface of the carrier sheet faces the back surface of the pragmatic pre-label sheet.

45. The process of claim 42 wherein the microvoided layer comprises, in a continuous phase, a polylactic-acid based material having dispersed therein void initiators selected from the group consisting of crosslinked organic microbeads, inorganic particles, non-crosslinked polymer particles that are immiscible with the polylactic-acid based material, and combinations thereof, the microvoided layer has a void volume of at least 25 percent by volume.

46. The process of claim 42 wherein the microvoided layer comprises, in a continuous phase, a polylactic-acid based material having dispersed therein a mixture of either crosslinked organic microbeads or inorganic particles in combination with non-crosslinked polymer particles that are immiscible with the polylactic-acid based material, the layer having a void volume of at least 25 percent by volume.

47. The process of claim 42 wherein the pragmatic polymer film further comprises a coextruded second layer on a side of the microvoided layer opposite the image-receiving layer which third layer comprises of a voided or non-voided material.

48. The process of claim 47 further comprising a coextruded third layer on a side of the second layer opposite the microvoided layer which third layer comprises of a microvoided material wherein the coextruded third layer comprises poly(lactic acid).

49. The process of claim 42 wherein the microvoided layer has a void volume of from 25 to 65 volume percent.

50. A label made from the pre-label sheet of claim 1 that can be adhesively applied to an objective object.

* * * * *